US007836610B2

(12) United States Patent
Laporte

(10) Patent No.: US 7,836,610 B2
(45) Date of Patent: Nov. 23, 2010

(54) ATTACHMENTS FOR AN ITEM OF FOOTWEAR

(76) Inventor: Maxime Laporte, 2833 Édouard-Montpetit, Suite 4, Montreal (CA) H3T 1J6

( * ) Notice: Subject to any disclaimer, the term of this patent is extended or adjusted under 35 U.S.C. 154(b) by 917 days.

(21) Appl. No.: 11/652,632

(22) Filed: Jan. 12, 2007

(65) Prior Publication Data

US 2007/0163148 A1 Jul. 19, 2007

(30) Foreign Application Priority Data

Jan. 13, 2006 (CA) ..... 2532705
Oct. 27, 2006 (CA) ..... 2566875

(51) Int. Cl.
*A43C 15/06* (2006.01)

(52) U.S. Cl. ..... 36/62

(58) Field of Classification Search ..... 36/61–67 R, 36/134

See application file for complete search history.

(56) References Cited

U.S. PATENT DOCUMENTS 997,055 A * 7/1911 Gilowitz ..... 36/61
1,024,981 A * 4/1912 Findlay ..... 36/62
1,160,425 A * 11/1915 Malmstrom ..... 36/61
1,256,300 A * 2/1918 Dunn ..... 36/61
2,331,607 A * 10/1943 Harvey ..... 36/61
2,640,283 A 6/1953 McCord
2,776,499 A * 1/1957 Giuntini ..... 36/135
3,713,233 A * 1/1973 Hunnicutt ..... 36/61
4,745,692 A 5/1988 Liao
5,353,522 A 10/1994 Wagner
5,459,948 A 10/1995 Aveni
6,360,455 B1 3/2002 Seo
6,675,504 B1 * 1/2004 Biancucci et al. ..... 36/59 R
6,813,847 B2 11/2004 Workman

FOREIGN PATENT DOCUMENTS

EP 1 044 621 10/2000
WO WO 2004/041016 5/2004

* cited by examiner

*Primary Examiner*—Ted Kavanaugh
(74) *Attorney, Agent, or Firm*—Stetina Brunda Garred & Brucker

(57) ABSTRACT

An attachment for an item of footwear having an outsole, the attachment comprising a body having first and second body surfaces, the body being releasably co-operable with the outsole in a first position in which the first body surface is disposable away from the outsole and in a second position in which the second body surface is disposable away from the outsole; an attaching portion which is associated with the body and which includes an inter-engageable formation for releasably attaching the attachment in the first and second positions; and a detaching portion which is associated with the body, the detaching portion having an edge portion moveable with respect to the body to allow the body to be released from the item of footwear. The invention also includes an outsole and an item of footwear to which the attachment can be releasably attached.

21 Claims, 17 Drawing Sheets

Fig. 14(a)
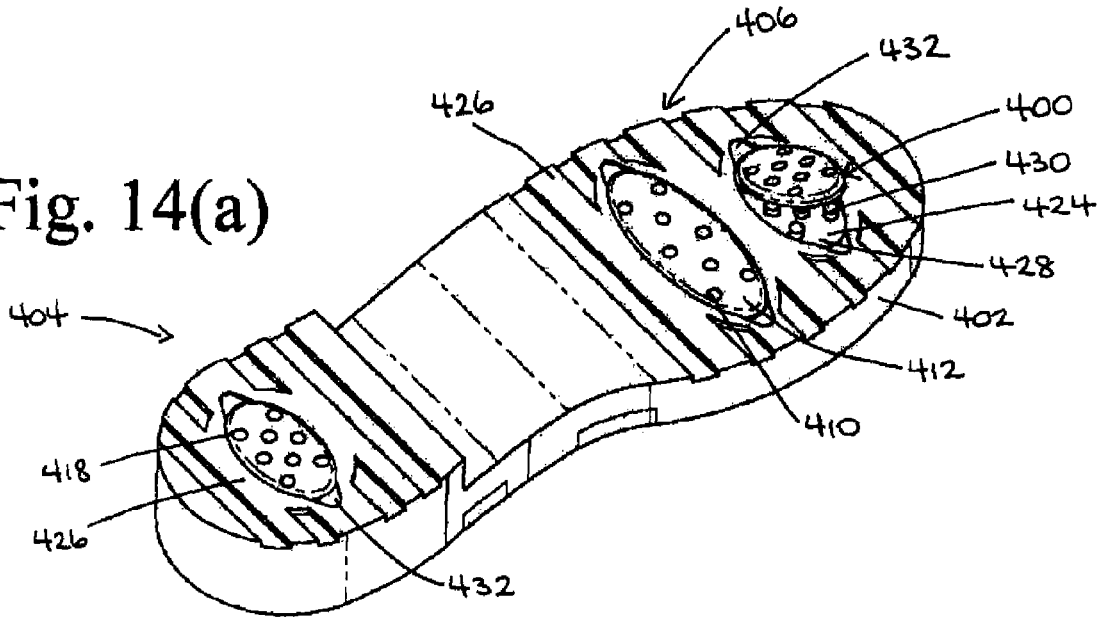
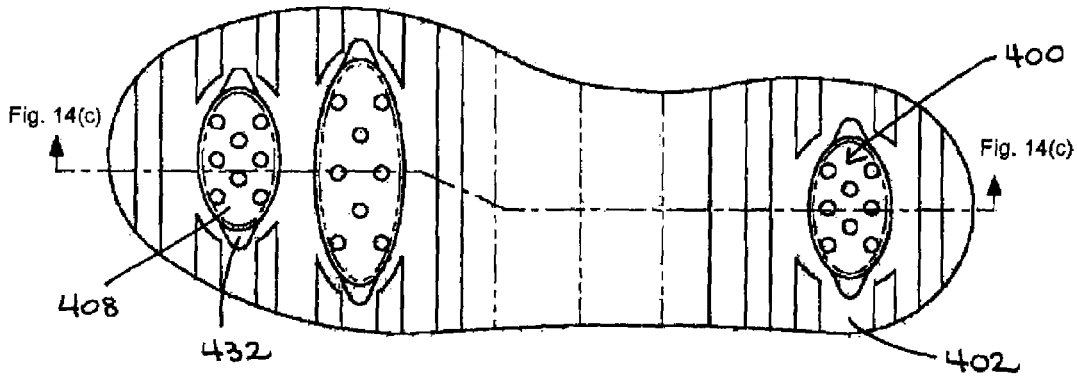
Fig. 14(b)
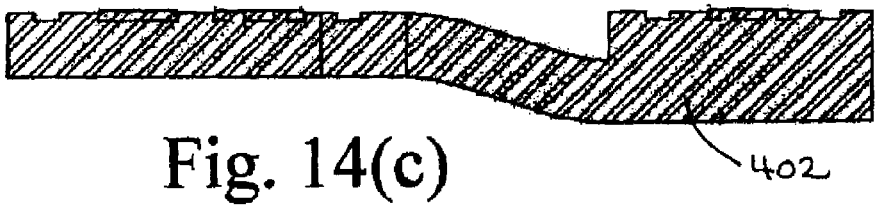
Fig. 14(c)

ATTACHMENTS FOR AN ITEM OF FOOTWEAR

CROSS REFERENCE TO RELATED APPLICATIONS

The Applicants hereby claim priority from Canadian patent application nos. 2,532,705 filed 13 Jan. 2006 and 2,566,875 filed 27 Oct. 2006, the contents of which are hereby incorporated by reference in their entirety.

FIELD OF THE INVENTION

The present invention generally relates to attachments for items of footwear and more specifically to attachments for use with items of footwear and the outsoles of items of footwear.

BACKGROUND OF THE INVENTION

It is known to provide outsoles of items of footwear, such as shoes and boots, with ground engaging elements having certain ground-engaging characteristics. For example, hiking and sports shoes having outsoles with spikes, studs or cleats to improve traction and provide anti-skid properties, and tap dancing shoes having taps attached to the outsoles with different sound properties, are known. However, there are circumstances where such ground-engaging elements should be disabled or changed such when a wearer of the item of footwear moves from an outdoor to an indoor location having a surface that could be damaged by spikes, studs or cleats, or when a different frictional characteristic is required. Under such circumstances, it is desirable to disable the ground-engaging elements at will for certain periods of time and thereafter reactivate them as needed. It is also desirable to change the ground-engaging property of the item of footwear without removing that item of footwear and donning another item.

Accordingly, some solutions have been provided in the prior art which include complex systems providing user activated stud retraction mechanisms. However, these are not found on the market given their generally poor overall performance and high manufacturing cost.

Other, more practical systems have also been provided which include attachments for outsoles, the attachments being moveable to expose different surfaces having different properties as required.

In U.S. Pat. No. 6,675,504, granted to Biancucci in January 2004, a shoe sole is provided with spikes projecting from one face of a support means. The support means is pivotably attached to the sole and is movable between a first position in which the support is fully received in a first recess provided in the ground contacting face of the sole with the spikes projecting outwardly, and a second position in which the support is fully received in a second recess with the spikes extending into said second recess. As only one of the recesses is used to receive the support means at any one time, the unused (empty) recess may fill with soil, snow, ice, and other debris while walking with the spike supporting means in the first or second positions. Moreover, the support means has a limited efficient area as it must be half the size of the total recess surface to enable it to flip from one recess to the other.

International publication No WO2004/041016 (published in May 2004) from the same inventors and applicants as U.S. Pat. No. 6,675,504 describes a similar concept to U.S. Pat. No. 6,675,504 where a sole is provided with a recess together with a support means receivable in the recess and having spikes projecting from one of its surfaces. In WO2004/041016, the support means is pivotably attached to the sole so that it can be lifted into and out of the recess. The attachment mechanism allows the support means to be rotated to expose its other face so that it is moveable between a first position in which the support means is fully received in the sole recess with the spikes facing outwardly, and a second position in which the support means is received in the recess with the spikes extending into the recess. However, the support means does not appear to be removable from the recess without the use of a tool to prise it out of the recess. This would mean that a wearer of an item of footwear with this sole would need to carry a tool with them. Furthermore, the pivoting mechanism is set into a recess which must necessarily be larger than the mechanism itself. The recess is likely to fill with soil, snow, ice, and other debris while walking with the spike supporting means in the first or second positions.

U.S. Pat. No. 6,360,455 entitled "Pack Boot with Retractable Crampons" issued to Seo on Mar. 26, 2002 also teaches a dual cavity flip concept with traction devices of still smaller effective surface than U.S. Pat. No. 6,675,504 and sharing similar disadvantages.

U.S. Pat. No. 4,745,692, granted to Liao on May 24, 1988, describes an anti-slip device comprising a slip-proof member pivotably mounted to the bottom of a shoe. The slip proof member has prongs extending from one of its faces and is receivable in a recess in the bottom of the shoe in one of two positions: one position with the spikes pointing outwardly and the other position with the spikes being received into the recess. However, the pivoting mechanism of U.S. Pat. No. 4,745,692 is complex and the design of the anti-slip device prone to accumulate dirt, snow or ice in the recess and in the pivoting mechanism which could cause jamming of the device and render operation difficult.

European patent application No EP1,044,621 (published on Oct. 18, 2000) discloses a shoe having a recess in its heel. The recess contains a receiving member for receiving a reversible element which has one spiked surface and an opposed smooth surface. The reversible element also has a tapered outer edge which corresponds with a similarly shaped groove in the receiving member. The element can be slid into the receiving member in two positions to expose either the spiked or the smooth surface. A hole is provided through the heel and the receiving member into which a locking member (e.g. a screw) is inserted to secure the reversible element in the receiving member. As the locking member is separate from the reversible element and the receiving member, it can become separated and lost. Also, adapting the heel of a shoe to include a receiving member would increase manufacturing costs. Finally, manipulating such a locking member is cumbersome for the wearer of the shoe.

U.S. Pat. No. 2,776,499 granted to Giuntini on Jan. 8, 1957 provides a reversible plate extending from the heel to the toe of an item of footwear. The plate includes cleats on one of its surfaces and is hingedly attached to the underside of the sole under the arch. The plate can be moved about a transverse axis between two positions: one position in which the plate overlies the front and rear portions of the sole with the cleats exposed and a second position in which the front portion of the plate is folded back over itself to hide the cleats by nesting the cleated face of the front portion into cleated portion of the rear portion. This necessarily increases the height of the heel portion of the item of footwear. Also, the hinge portion is vulnerable to collect debris which would impair the hinging mechanism.

Therefore, it is desired to overcome or reduce at least some of the above-described problems.

SUMMARY OF THE INVENTION

The present invention reduces the difficulties and disadvantages of the aforesaid designs by providing an attachment which can be easily attached and detached from an item of footwear by the user without the use of tools or complex attaching and/or detaching mechanisms. As the attachment is a simple construction it is easy to manufacture with low manufacturing costs. The Applicant has found the surprising discovery that such an attachment having a detaching portion associated with a body of the attachment and having an edge portion moveable with respect to the body overcomes the problems associated with the aforesaid designs. It will be appreciated that the above described embodiments according to the present invention obviate the limitations and drawbacks of the prior art devices, namely by improving reversibility, efficient surface area, reliability, durability, clearing of cavities and production costs, thus enabling safe and convenient use in a wide range of applications.

In a broad sense, the present invention concerns an attachment for an item of footwear, the attachment comprising a body having first and second body surfaces, the body being releasably co-operable with the outsole in a first position in which the first body surface is disposable away from the outsole and in a second position in which the second body surface is disposable away from the outsole; an attaching portion which is associated with the body and which includes an inter-engageable formation for releasably attaching the attachment in the first and second positions; and a detaching portion which is associated with the body, the detaching portion having an edge portion moveable with respect to the body to allow the attachment to be released from the item of footwear.

The edge portion may be arranged for manipulation by a user's hand when the attachment is in the first or second positions to move the edge portion with respect to the body. The outsole may include a recess, and the body shaped to be receivable in the recess. The first body surface has a first surface-engaging property and the second body surface has a second surface-engaging property. The first or second surface-engaging properties can be a frictional property or a sound generational property of the surface. In this regard, the first body surface may includes at least one protrusion for frictional engagement with a surface which may be an anti-skid cleat. The outsole may be provided with at least one opening corresponding to the at least one protrusion such that when the first body surface is disposable towards the outsole when the body is in the second position, the at least one protrusion is shaped to be receivable in the opening in the outsole when the body is in the second position. The first and second surface-engaging properties may be different. The body has at least one axis of symmetry for positioning in the first and second positions. Further symmetry is also possible.

In one embodiment of the present invention, the detaching portion includes an outer edge portion of the body. The outsole comprises a protrusion, and the inter-engageable formation comprises at least one opening within the body for engageably receiving the protrusion. The body may be resiliently deformable and disc-shaped. The first and second surfaces of the body are substantially planar.

In another embodiment of the present invention, the attaching portion of the attachment extends from one side of the body and includes an arm having an arm opening. The outsole includes a protrusion, the arm opening being sized and shaped to engageably receive the protrusion. The arm and the body are integrally formed into a single piece which is resiliently deformable. The single piece may include at least a first layer of material forming the body and at least a second layer of material forming the attaching portion, the first layer being less resilient than the second layer. The detaching portion is integral with the attaching portion and includes an outer edge portion of the attaching portion. The body can extend across the outsole when the attachment is in the first or second positions. The attachment includes a second attaching portion located at another side of the body from the first attaching portion, the second attaching portion may include an edge defining an opening in the body. The outsole has a protrusion, and the edge is shaped, for example tapered, to engage with the protrusion to attach the attachment to the item of footwear.

In an alternative embodiment, the second attaching portion includes a second arm having an opening, the second arm extending from an oppositely facing side of the body portion to the first arm.

In a further alternative embodiment, the attaching portion includes at least one arm having a free end. The outsole includes an opening, the free end being shaped to be engageably received into the opening. The detaching portion includes an edge portion of the arm. The arm may be attached to the body by a hinge. The attaching portion includes two pairs of arms, all having free ends. The two pairs of arms extend from substantially oppositely facing ends of the body. The outsole includes at least one opening for engageably receiving the free ends, each pair of arms being located adjacent each other such that moving the arms towards each other disengages the free ends of the arms from the at least one opening, and moving the arms away from each other engages the free ends of the arms with the at least one opening.

In yet another further alternative embodiment, the detaching portion comprises a tab member extending from the body, the tab member having an edge portion for manipulation by a user's hand to detach the attachment from the item of footwear. The tab member may have a recessed holding portion. The inter-engageable formation includes an edge defining an opening in the body and the outsole includes at least one protrusion and the edge is shaped to engage with the protrusion. At least a portion of the edge may be tapered. The attachment may further comprise a bridging member extending across the opening. The bridging member may include an opening formed therethrough.

From another aspect, the present invention extends to an outsole for an item of footwear, the outsole comprising an inter-engageable formation for releasably attaching an attachment as described above. The outsole is shaped to allow the detaching portion of the attachment to be manipulatable by a user's hand to detach the attachment from the item of footwear. The inter-engageable formation may include at least one protrusion extending from the outsole for engagement with a corresponding at least one opening in the attachment to releasably attach the attachment to the outsole. The at least one protrusion can be at a toe-end, a heel-end and/or at a side of the outsole, and be resiliently deformable. Optionally, the protrusion may be integral with a shaft member which is associated with the outsole and is more rigid than the outsole.

In another embodiment of the outsole, the inter-engageable formation may include an edge defining a recess in the surface-engaging face, the recess being shaped to receive at least a portion of the attachment. A portion of the edge of the recess can be shaped to allow a user to manipulate by hand the attachment when the attachment is in the first or second positions to detach the attachment from the item of footwear. In this respect, a portion of the edge of the recess may be lipped to allow retention of the attachment in the recess.

The recess has a base and a side wall. A protrusion may extend from the recess base, the protrusion being shaped to engage with a corresponding opening in the attachment to releasably attach the attachment to the outsole. At least one opening may be formed in the base of the recess which is shaped to receive at least one corresponding protrusion of the attachment. The recess side wall may have at least one opening for engagement with a corresponding protrusion of the attachment.

According to another aspect of the invention, there is provided an attachment and an outsole as described above.

According to yet another aspect of the invention, there is provided an item of footwear including an outsole and/or an attachment as described above.

Advantageously, the invention provides footwear, such as boots or shoes, with multiple functions such as improved grip in slippery surfaces. This is achieved by a reversible attachment which can be fitted to an outsole. A user can switch between two surface-engaging faces of an item of footwear without changing the item of footwear. Of note is that each attachment occupies exactly the same space in either position in its closely mating (conforming) recess such that introduction of ice, snow and/or debris in the recess is prevented. Moreover, removal of an attachment provides self-cleaning of the recess, protrusion and notches surroundings, which ensures ease of repositioning of the attachments. The attachment is essentially maintenance free. Also, substantially the entire first or second surface of the body is useable as part of the surface-engaging face.

The surface engaging faces of the attachment may be replaced, or the attachment may be moved between the first and second positions when one of the surfaces wears out. In addition, by virtue of the attachment being removable from the outsole, the entire attachment may be replaced once worn through rather than the item of footwear. By virtue of the inter-engaging formation, the attachment can be releasably attached to the item of footwear. The fastening system can be said to include an inter-engaging formation acting between the attaching portion and the item of footwear. This allows the attachment to be attached to the outsole in both the first and second positions without the need for more complex attachment mechanisms. The inter-engageable formation permits the attachment to remain fastened to the item of footwear when needed and for it to be released when detachment is required. Moreover, by virtue of the attaching and detaching portions being associated with the body, additional attaching and detaching mechanisms which are separate from the attachment and which can be lost whilst reversing the attachment are not required.

BRIEF DESCRIPTION OF THE DRAWINGS

Further aspects and advantages of the present invention will become better understood with reference to the description in association with the following in which:

FIG. 2(*b*) is a cross-section along line A-A of FIG. 2(*a*);

FIG. 6(*b*) is a cross-section along line A-A of FIG. 6(*a*);

FIG. 7(*c*) is a cross-section along line A-A of FIG. 7(*b*);

FIG. 8(*c*) is a cross-section along line A-A of FIG. 8(*b*);

FIG. 9(*b*) is a cross-section along line A-A of FIG. 9(*a*);

FIG. 11(*b*) is a side view of the attachments and the outsole of FIG. 11(*a*);

FIG. 12(*b*) is a cross-section along line A-A of the attachment of FIG. 12(*a*);

FIG. 13(*b*) is a cross-section along line A-A of the attachment of FIG. 13(*a*);

FIGS. 14(*a*) and (*b*) are perspective and plan views, respectively, of a heel attachment, front attachments and an outsole according to a yet further embodiment of the present invention;

FIG. 14(*c*) is a cross-section along line A-A of FIG. 14(*b*);

FIG. 15(*b*) is a cross-section along line A-A of the attachment of FIG. 15(*a*);

FIG. 16(*b*) is a cross-section along line A-A of the attachment of FIG. 16(*a*);

FIG. 18(*c*) is a cross-section along line A-A of FIG. 18(*b*);

FIG. 19(*b*) is a cross-section along line A-A of FIG. 19(*a*); and

DETAILED DESCRIPTION OF THE INVENTION

Figure 1:
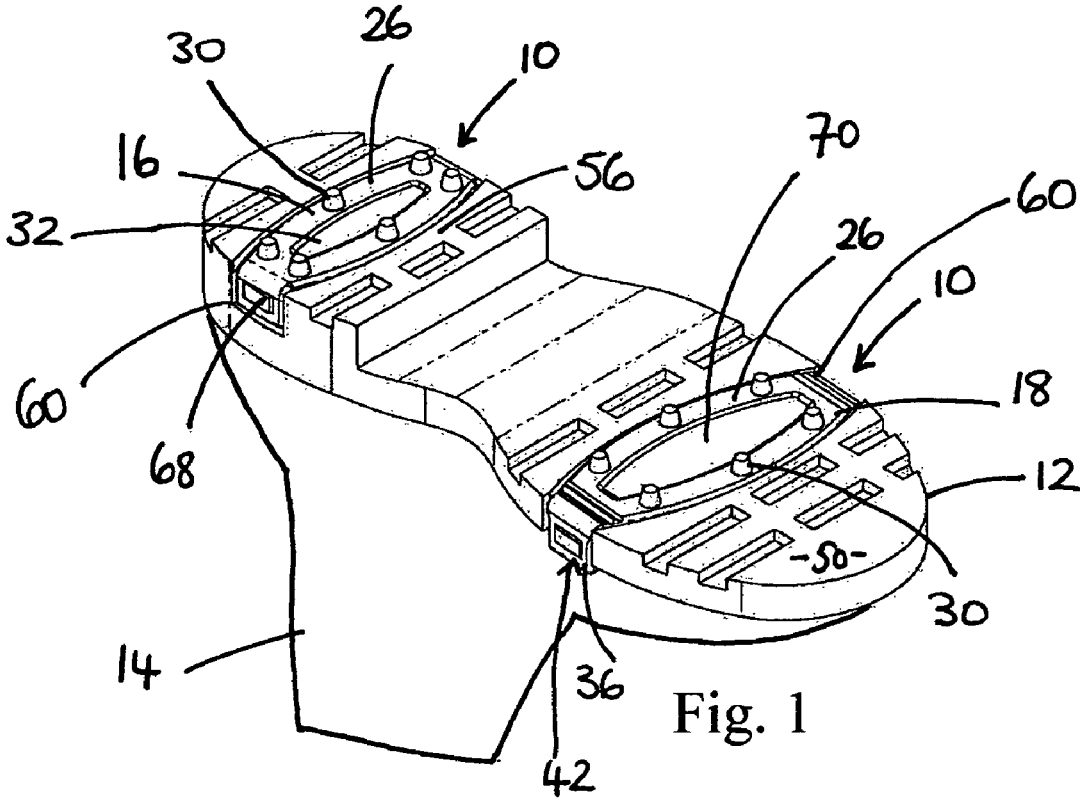
FIG. 1 is a perspective view of an item of footwear having an outsole and front and heel attachments, according to an embodiment of the present invention.

Although the present invention will be described with reference to embodiments adapted for improving traction on surfaces, for example slippery or icy surfaces, persons skilled in the art will appreciate other applications of the present invention wherein modification of engaging properties with the ground, floor or any other surface may be desirable. For example, an embodiment of the invention may enable bowling players to change the frictional properties of their footwear without changing the footwear itself. Also, the invention may enable tap dancers to turn taps on or off as desired.

With reference to FIGS. 1 to 4, attachments 10 for an item of footwear according to an embodiment of the invention are shown mounted to an outsole 12 of an item of footwear 14. The attachments 10 include a heel attachment 16 and a front attachment 18. Broadly speaking, each attachment 10 includes a body 20, and attaching and detaching portions 22, 24 which are associated with the body. The heel and front attachments 16, 18 are illustrated in a default position, disassembled from the outsole 12, in FIGS. 3 and 4 respectively. The same reference numerals have been used to illustrate similar parts.

The body 20 has first and second body surfaces 26, 28 and is releasably co-operable with the outsole 12 in a first position in which the first body surface 26 is disposable away from the outsole 12 and in a second position in which the second body 28 surface is disposable away from the outsole 12. A plurality of protrusions 30 extend from the first body surface 26 whereas the second body surface 28 is substantially planar (flat). Therefore, the first and second body surfaces 26, 28 have different ground-engaging properties. Namely, the first body surface 26 can provide better traction in mud, snow or ice, for example, than the second body surface 28. As will be described in detail later, the attachments 10 can be mounted to the outsole 12 with either body surface 26, 28 facing outwardly and forming part of a ground-engaging surface of the outsole 12. This permits a wearer of the item of footwear 14 to change the ground-engaging property of his or her item of footwear 14 simply by changing the mounting position of the attachment 10 to the outsole 12.

The body 20 has a body opening 32 formed through a central portion, the purpose of which is to save on material and hence manufacturing costs. Alternatively, the body 20 may also be solid to increase the efficient surface area of the first and second faces 26, 28 according to the intended application. In the embodiment illustrated in FIGS. 1 to 4, the body 20 is elongate, typically it is elliptical in shape. The body 20 is symmetrical about at least one axis to allow the attachment 10 to be mounted to the outsole 12 in the first and second positions. As can be seen, the body is in fact symmetrical about two axes: a longitudinal axis 34 and a transverse axis 35. This allows the attachment 10 to be mounted to the outsole 12 with either body surface 26, 28 exposed and in both a left to right and in a right to left configuration. The attachments are also interchangeable between left and right foots of the item of footwear. The body 20 is sized to extend across the portion of the outsole 12 to which it is attachable. In this respect, it can be seen that the front attachment 18 is larger in size than the heel attachment 16.

Figure 2A:
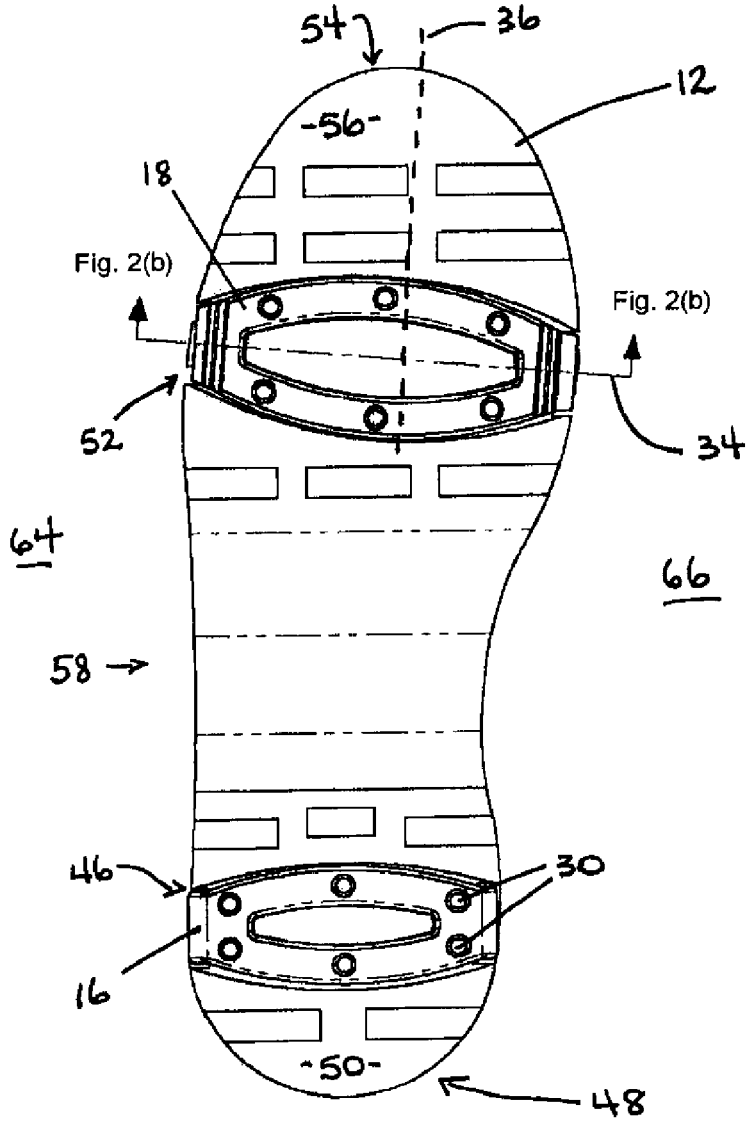
FIG. 2(*a*) is a plan view of the attachments and the outsole of FIG. 1.
Figure 2B:
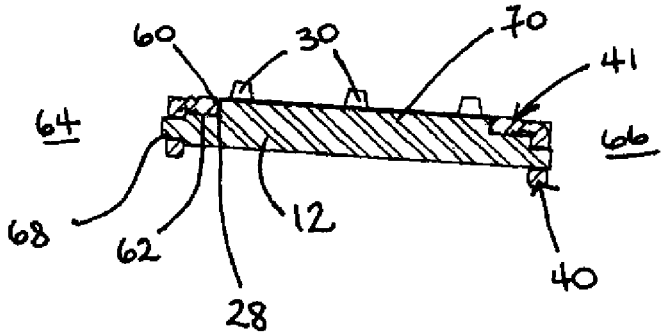
Figure 3A:
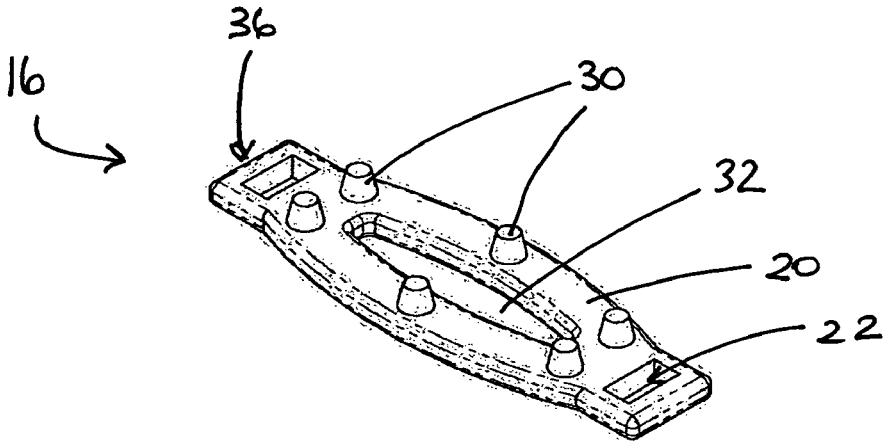
FIGS. 3(*a*), (*b*) and (*c*) are perspective, plan and side views, respectively, of the heel attachment of FIG. 1.
Figure 3B:
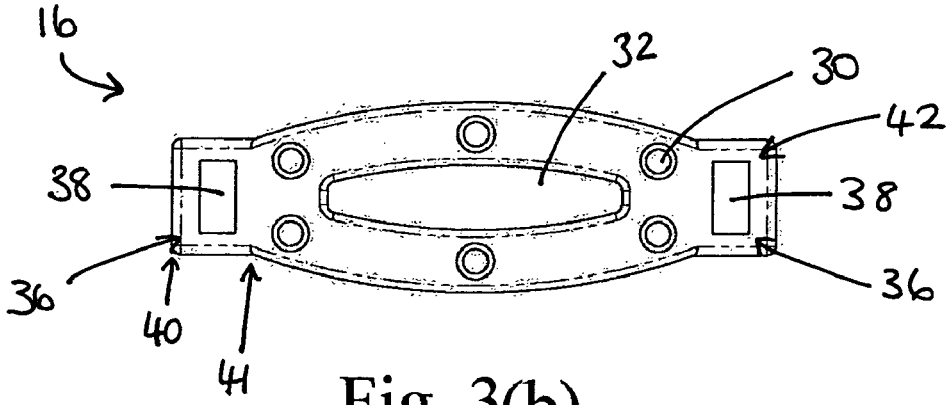
Figure 3C:
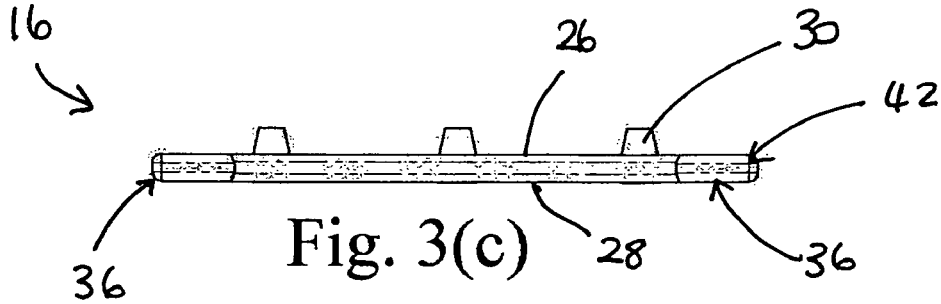
Figure 4A:
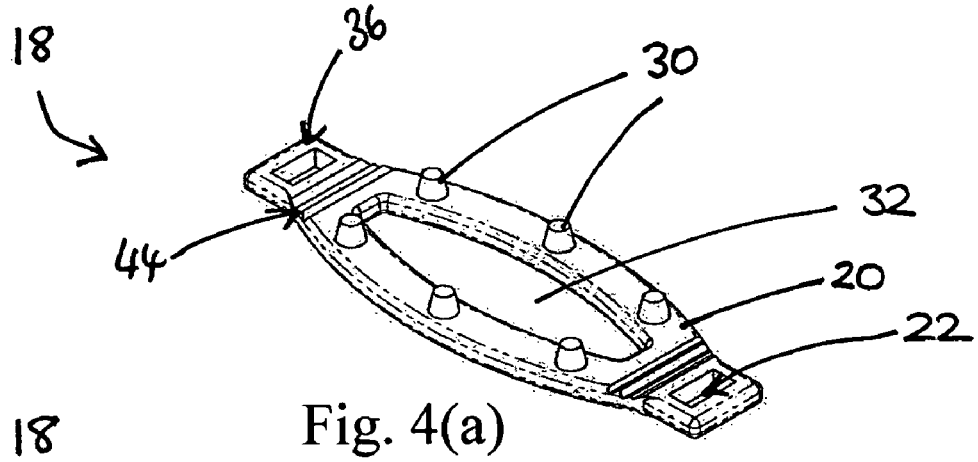
FIGS. 4(*a*), (*b*) and (*c*) are perspective, plan and side views, respectively, of the front attachment of FIG. 1.
Figure 4B:
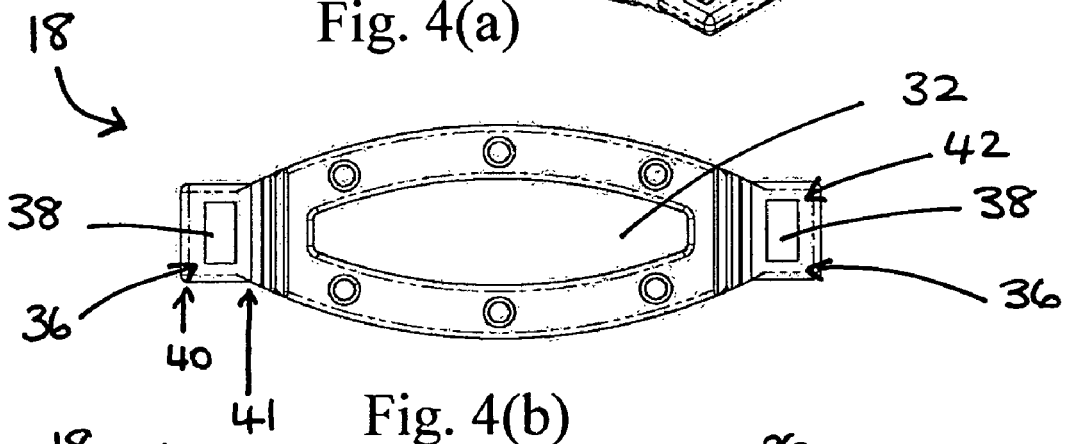
Figure 4C:
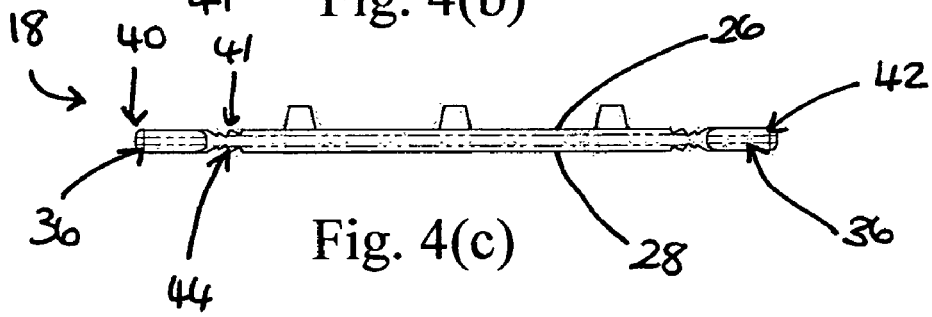

As best illustrated in FIGS. 2 to 4, the attaching portion 22 is connected to the body 20. The attaching portion 22 is in the form of a pair of arms 36 extending from different sides of the body 20. Each arm 36 has a free end 40 and a join end 41. The arm 36 is connected to the body 20 at its join end 41. Each arm 36 is independently moveable with respect to the body 20, such as for example, twisting about the join end 41 or hinged about the join end 41, typically towards or away from the body 20. An arm opening 38 is formed near the free end 40 of the arm 36. The arm opening 38 is shaped to engageably receive a portion of the outsole 12 or item of footwear 14 to secure the attachment 10 to the item of footwear 14. The arms 36 extend from oppositely facing sides of the body and form a single piece with the body. In the embodiment illustrated, the arm openings 38 are tapered but can be of any size or shape suitable for receiving a portion of the outsole or item of footwear.

The detaching portion 24 comprises an outer edge portion 42 of the attaching portion 22. Specifically, the detaching portion 24 includes the free ends 40 of the arms 36. These free ends 40 can be manipulated by a user's hands (finger(s) or thumb(s)) to move them with respect to the body 20 to allow the attachment 10 to be released from the item of footwear 14. The free ends 40 can be manipulated and moved with respect to the body when the body is attached to the outsole. The detaching portion 24 can be said to have an edge portion moveable with respect to the body 20.

The above description of the attachment 10 applies equally to the heel attachment 16 and the front attachment 18. The front attachment 18 differs from the heel attachment 16 in its physical dimensions, which have been adapted to fit the larger forefoot location. A further difference is that the arms 36 of the front attachment 18 comprise a ribbed portion 44 at the join end 41. It will be appreciated that this ribbed portion 44 comprises grooves which effectively thin the thickness of the arms 36 in the area where bending is required. Therefore, the ribbed portion 44 serves to improve the bending and flexibility of the arms 36 and aids in stretching the arms 36 away from the body 20 to attach the attachment 10 to the item of footwear 14. The ribbed portion 44 may be formed during the molding of the arms 36. The arms 36 may also have any other structure suitable for obtaining the desired resilience and deformability required to attach the attachment 10 to the outsole 12. These arm constructions may also be applied to the heel attachment 16.

The body 20, and attaching and detaching portions 22, 24 of the attachments 10 are integrally formed from a resiliently deformable material such as for example a polymeric material, for example rubber, polyurethane or neoprene™ and the like. Alternatively, the attachments 10 can be formed from at least two layers of material (i.e. laminated). For example, the body 20 comprising a semi-rigid core joined to a layer of resiliently deformable material which also forms the arms 36. In this way, the body 20 maintains rigidity while the arms 36 are formed from the resiliently deformable material to enable their easy bending and deformability. The arms 36 may also be multi-layered. Alternatively, the arms 36 and the body 20 may be formed separately and joined together to form the attachment 10. The attachments can be formed using methods known in the art such as by molding (e.g. injection or screw molding). The protrusions 30 which project from the first body surface 26 may be formed separately (for example, from metal) from the body 20 and be joined to the body 20 during or after the formation of the attachment 10.

Referring now to the outsole 12, illustrated in FIGS. 1 and 2, which is attached to the item of footwear 14 by conventional means such as by stitching or adhesive. The outsole comprises a heel or rear region 46 at a heel end 48 of the outsole 12, the heel region 46 having a heel ground-engaging surface 50. A forefoot region 52 of the outsole 12 is at a toe-end 54 of the outsole 12, and has a forefoot ground-engaging surface 56. The heel and forefoot regions 46, 52 of the outsole 12 are separated by an arch region 58. A recess 60 is formed at each of the heel and forefoot regions 46, 52 for receiving the attachments 10. Each recess 60 has a bottom surface 62 and extends between a left side 64 and a right side 66 of the outsole 12. The recess 60 is shaped to receive at least the attachment body 20. As can be seen most clearly from FIGS. 2(*a*) and (*b*), a protrusion 68 extends from both sides 64, 66 of the recess 60 and is shaped to engage with the arm openings 38 of the attachments 10 to hold them in place on the outsole 12. Another protrusion 70 extends from the bottom face 62 of the recess 60 and is sized and shaped to correspond to the size and shape of the body opening 32 such that it is received in the body opening 32. In embodiments of the body 20 which do not have the body opening 32, the outsole recess 60 will be shaped correspondingly by not having the further protrusion 70.

When the attachment 10 is mounted to the outsole 12 with the first body surface 26 and protrusions 30 facing outwardly (first position), the second body surface 28 lies against the bottom face 62 of the recess 60. The depth of the recess 60 allows the protrusions 30 extending from the body 20 to project beyond the ground-engaging surface 50 or 56 of the outsole when the attachment is in this position. To allow the second body surface 28 of the attachment 10 to lie substantially flush with the ground-engaging surfaces of the heel 22 when the attachment 12 is mounted in the second position (with the second body surface 28 facing outwardly), openings (not shown) for receiving the protrusions 30 of the first body surface 26 are provided in the bottom face 62 of the recess 60. Alternatively, the outsole 12 may not have a recess 60 so that the attachments 10 are mounted over the ground-engaging surfaces of the outsole 12.

Referring to FIGS. 1 and 2, the attachments 10 are mounted to the outsole 12 by nesting the attachment body 20 into the corresponding recess 60 of the outsole 12 with one of the body surfaces 26, 28 facing into the recess and the other of the body surfaces 26, 28 facing outwardly. Each arm 36 is then moved towards its corresponding recess protrusion 68 by stretching the arm if required and bending the arm 36 at the join end 41 and engaging the arm opening 38 with the recess protrusion 68. To allow the attachments 10 to be mounted taut onto the outsole 12, the length of the arms 36 are slightly shorter than required so that they must be stretched to engage the arm opening 38 with the recess protrusion 68. Conveniently, a user may grip any portion of the arm such as the free end 40 of the arm 36 to move it into position and to catch the protrusion 68 into its respective arm opening 38. The attachments 10 can be completely removed from the outsole 12 by the user gripping the free end 40 of one of the arms 36 and disengaging its arm opening 38 from the outsole protrusion 68 by moving the arm 36 free of the outsole protrusion 68, typically in a direction towards the exposed face of the attachment 10. FIG. 2(*b*) clearly illustrates how the free end can protrude away from the outsole to allow a user to grip it more easily with his or her hands. To encourage the outsole protrusion 68 to disengage from the arm opening 38, a user can also push on a free end 72 of the outsole protrusion.

As described above, the attachments 10 can be attached to the outsole 12 with either face 26, 28 exposed and forming part of the ground-engaging surfaces 50, 56 of the outsole 12. Thus, the attachments are reversible. In this way, the user may alter the ground-engaging properties of his or her item of footwear by exposing a different body surface 26, 28 of the attachment body 20. For example, the attachment 10 can be mounted to the outsole 12 with the first face 26 facing outwardly when the user requires increased traction whilst walking outdoors and the attachment 12 can simply be reversed to expose the smoother second face 28 when the user moves indoors to prevent damaging interior floors and surfaces.

The fastening system of the arm opening 38 and the recess protrusion 68 can be replaced by equivalent sets of inter-engaging formations. For example, the protrusions may be associated with the arms 36 and the openings with the outsole 12. Also, the openings can be of any shape and need not be tapered. The protrusions can also have any other shape or configuration other than that shown in FIGS. 1 and 2 such as a mushroom-headed pin or hook-shaped. Furthermore, the openings may be slightly smaller than the diameter of the protrusions and either the edges defining the openings or the protrusions themselves may be made of a resilient material to ensure a tight fit. It is also conceivable that the protrusions extend from un-recessed portions of the outsole or from the upper of the item of footwear itself. Alternatively, additional inter-engaging formations may be provided for additional attachment security.

An alternative embodiment of the invention of FIGS. 1 to 4 is shown in FIGS. 5 to 8. This embodiment includes attachments 100 engaged with an outsole 102. The attachments 100 of FIGS. 5 to 8 differ from those of FIGS. 1 to 4 in that they have been adapted to be mountable in an orientation transverse to that of the attachments 10 of FIGS. 1 to 4. The attachments 100 comprise a heel attachment 104 and a front attachment 106 which differ from each other only in size and shape and so will not be described separately.

Each attachment 100 comprises a body 108, an attaching portion 110 and a detaching portion 112. The body 108 has first and second body surfaces 114, 116. A plurality of protrusions 118 extend from the first body surface 114 and the second body surface 116 is substantially planar. The body 108 has a body opening 120 formed through a central portion and defined by an opening edge 121. The body 108 is symmetrical about a longitudinal axis 122 which allows the attachment 100 to be mounted to the outsole 102 with either body surface 114, 116 exposed.

The attaching portion 110 includes a first attaching portion 122 and a second attaching portion 123. The first attaching portion 122 is in the form of an arm 124, extending from one side of the body 108, and having an arm opening 126. The structure and function of the arm is essentially identical to that of FIGS. 1 to 4 and so will not be repeated here. The second attaching portion 123 includes a portion 128 of the opening edge 121 which is shaped to inter-engage a portion of the outsole 102. The second attaching portion 123 is located at an oppositely facing side of the body 108 to the arm 124. The opening edge portion 128 is tapered towards the arm 124 (i.e. gets thinner towards the arm 124).

The detaching portion 112 is an outer edge portion 130 of the arm 124 and is as described for the previous embodiment.

The outsole 102 has a recess 132 for receiving the body 108 of the attachment 100 which differs from that of the previous embodiment in that it includes only a single protrusion 134 for engagement with the arm opening 126. The protrusion 134 is mushroom-shaped but it can have any other equivalent shape. For the heel attachment 104, the protrusion 134 extends from a heel-end 136 of the outsole 102, and for the front attachment 106, the protrusion 134 extends from a toe-end 138 of the outsole 102.

The outsole recess 132 has a bottom face 140 from which extends a second protrusion 142 corresponding in shape and position to the body opening 120 so that it can be received by the body opening 120. An edge 144 of the protrusion 142 corresponds in position to the second attaching portion 123 of the attachment 100 and is shaped to inter-engage with the second attaching portion 123. Specifically, the protrusion edge 144 is lipped and defines a slot or groove 146 for receiving the opening edge portion 128. The lip or tab may be tapered to ensure that the outwardly facing body surface 114, 116 lies substantially flush with a ground engaging surface 148 of the outsole 102 when the attachment 100 is mounted in either position to the outsole 102.

Figures 5A, 5B:
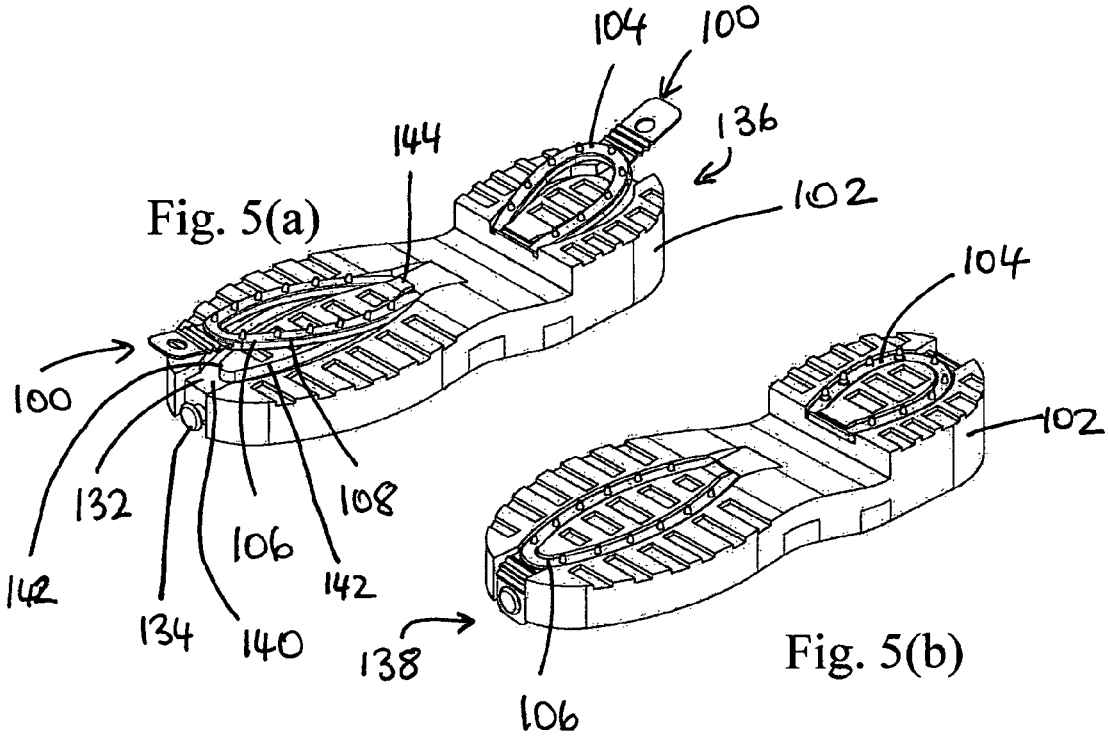
FIG. 5 is a perspective view of a heel attachment, a front attachment and an outsole according to another embodiment of the present invention, when the attachments are (a) partially removed from the outsole, and (b) attached to the outsole.

As can be seen in FIG. 5(*a*), the attachments 100 can be mounted to the outsole 102 by firstly inserting the second attaching portion 123 of the attachment 100 in the corresponding slot 146 and then nesting the body 108 in the outsole recess 132. The arm 124 must then be moved towards its corresponding protrusion 134 and the arm opening 126 engaged with the protrusion 134, as in the previous embodiment. In this way, both ends of the attachment 100 are firmly anchored to the outsole 102 and the body 108 is properly nested and stable in the recess 132. As for the attachments 10 of FIGS. 1 to 4, the body opening 120 could be reduced in size or eliminated according to the needs of the envisaged application, as long as an inter-engageable portion is provided to preserve the functionality of the second attaching portion 123 and the reversibility of the attachment. Should such a modification be implemented, the outsole 102 may also be adapted accordingly without affecting the performance of the invention other than by increasing the areas of the efficient surfaces of the attachments 100.

The detachment of the attachment 100 from the outsole 102 is initiated in the same way as in the previous embodiment. Namely, the arm opening 126 is disengaged from the outsole protrusion 134 by a user moving the detaching portion 112 with respect to the body 108. The attachment 100 is lifted away from the body 108, pivoting about the second attaching portion 123. Finally, the attachment 100 is moved away from the protrusion 134 to disengage the body opening edge 144 from the slot 146.

Figure 6A:
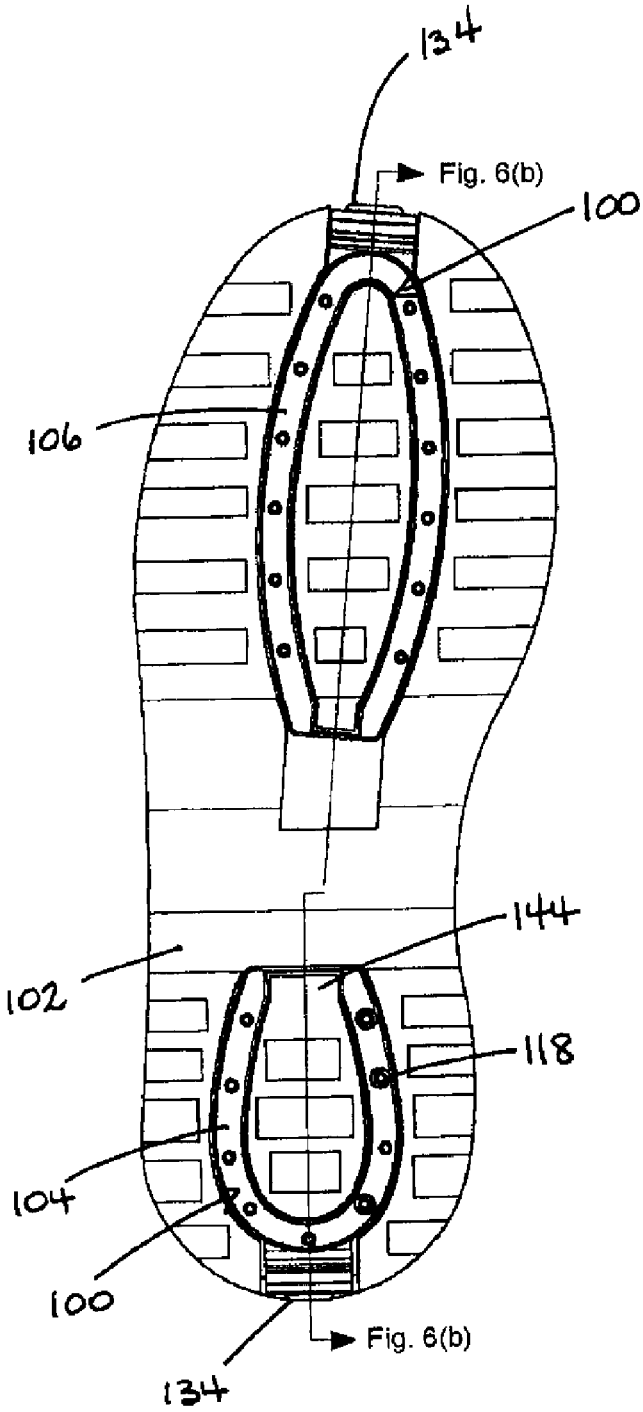
FIG. 6(*a*) is a plan view of the attachments and outsole of FIG. 5(*b*)
Figure 6B:
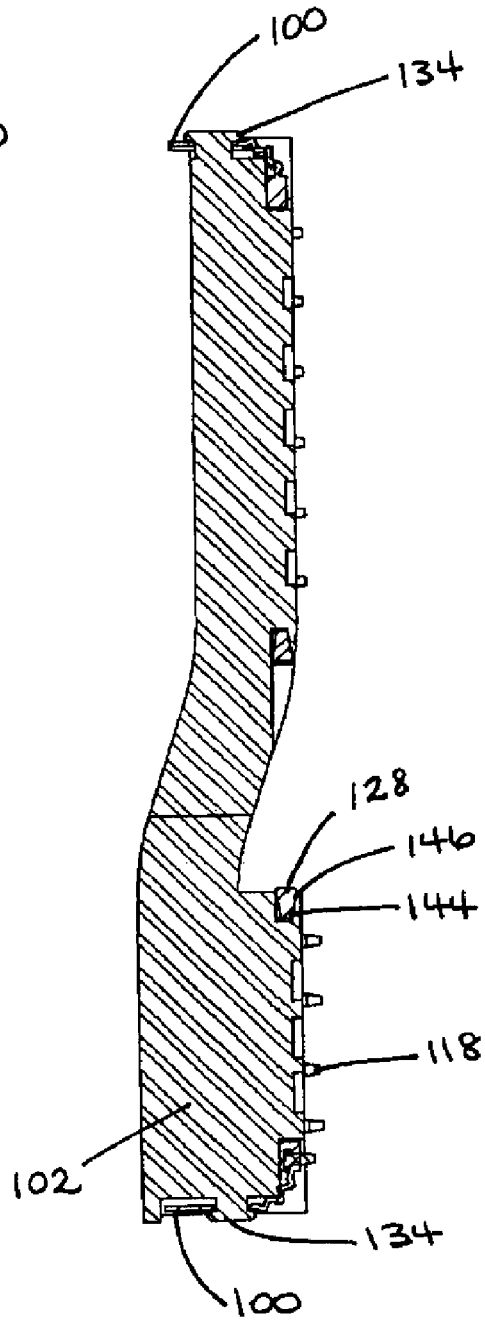
Figure 7A:
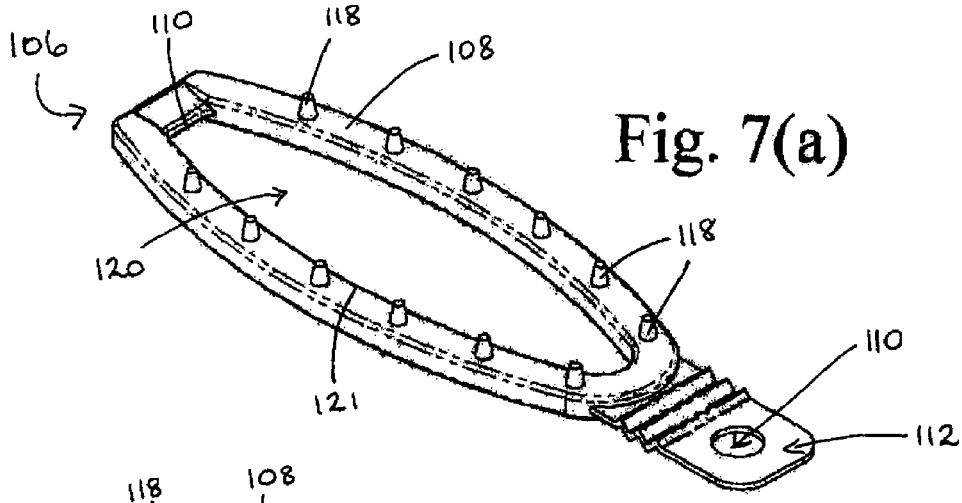
FIGS. 7(*a*) and (*b*) are perspective and plan views of the front attachment of FIG. 5.
Figure 7B:
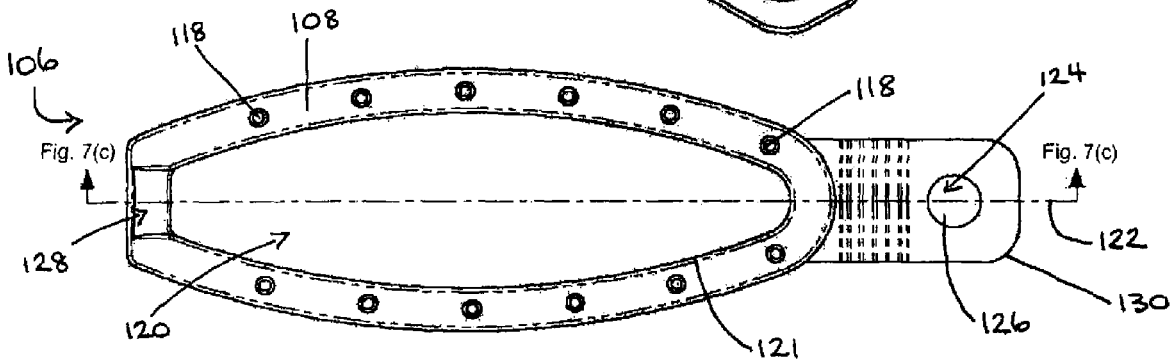
Figure 7C:
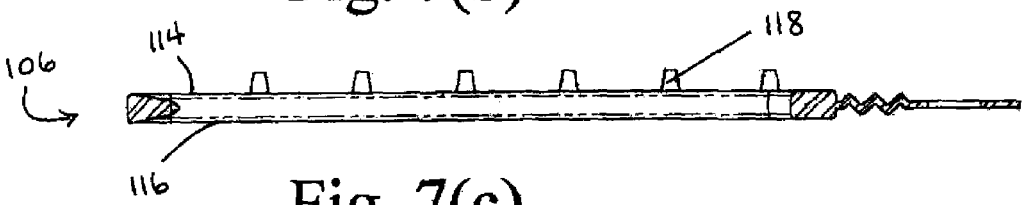
Figure 8A:
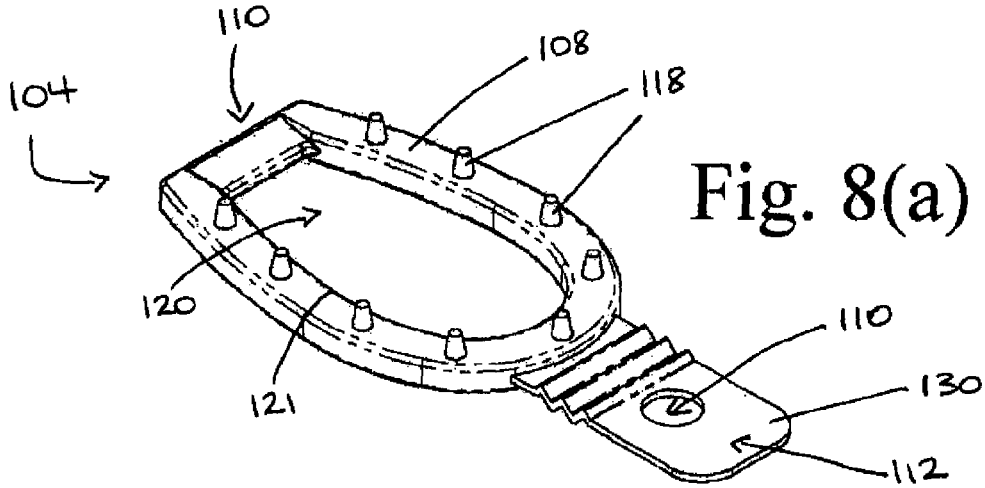
FIGS. 8(*a*) and (*b*) are perspective and plan views of the heel attachment of FIG. 5.
Figure 8B:
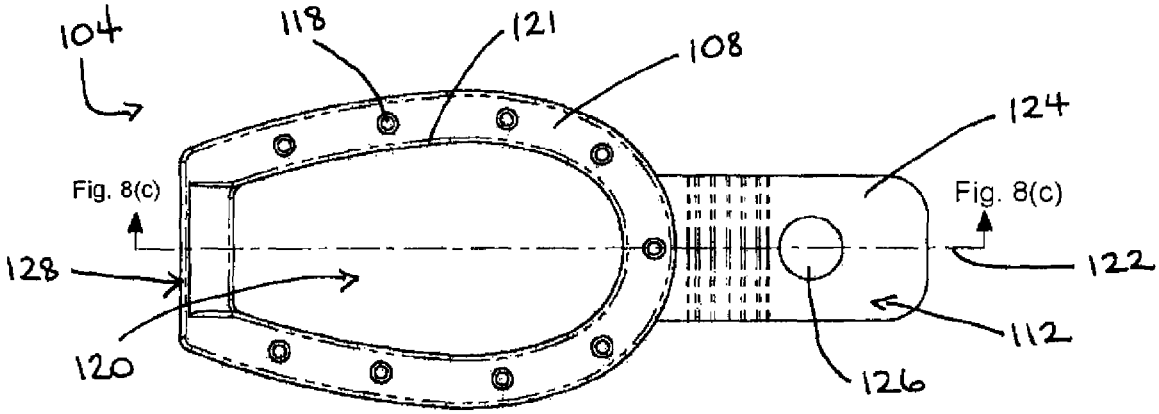
Figure 8C:
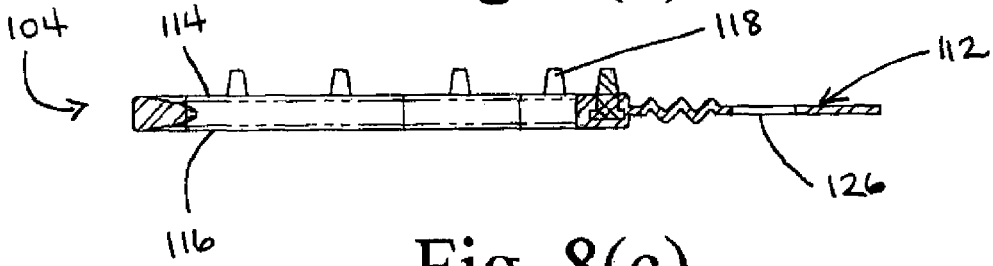
Figure 9A:
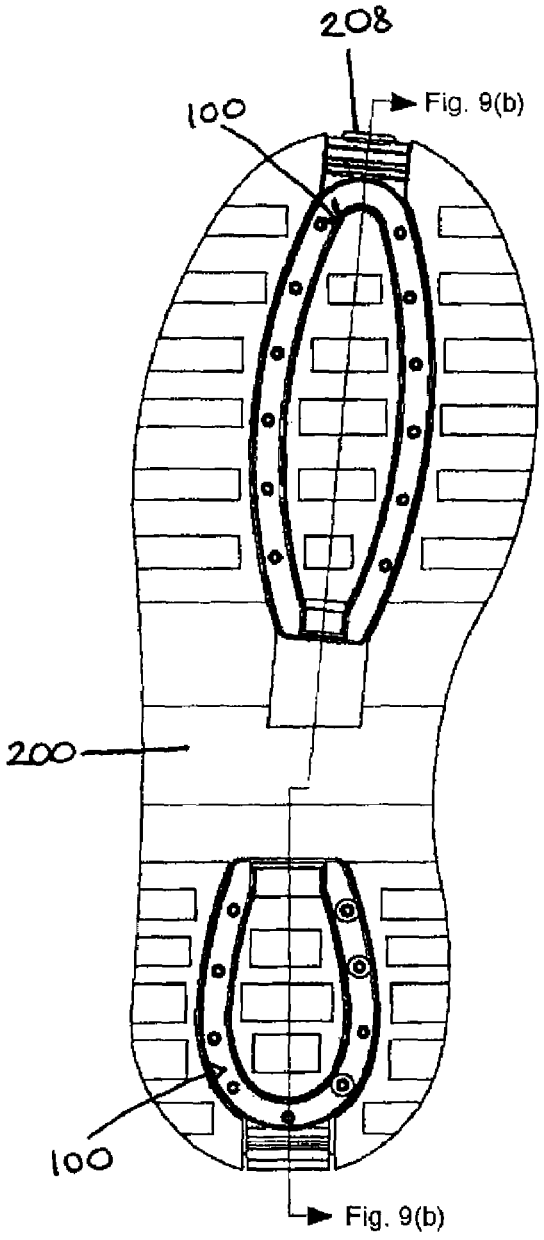
FIG. 9(*a*) is a plan view of an outsole, and heel and front attachments according to a further embodiment of the present invention.
Figure 9B:
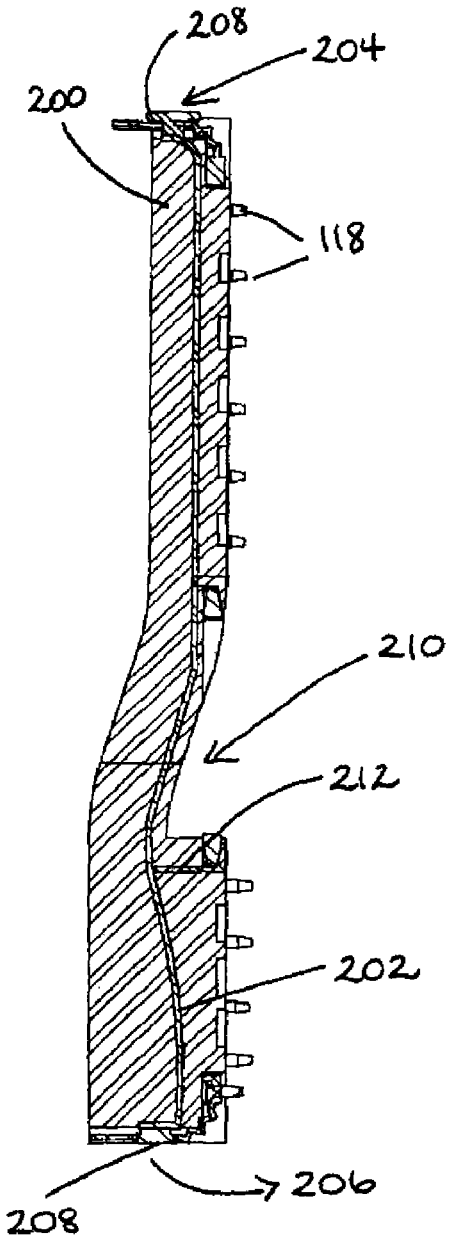

In FIG. 9, an alternative outsole 200 is provided for use with the attachment 100 of FIGS. 5 to 8. The outsole 200 includes a shaft member 202 having a toe-end 204 and a heel-end 206. A protrusion 208, corresponding to the protrusion 134 of FIGS. 5 and 6, is provided at each of the toe- and heel-ends 204, 206 for engagement with the arm opening 126 of the attachment 100. The shaft member 202 is embedded within the outsole 200, and is positioned to extend along the length of the outsole 200 such that the protrusions 208 extend beyond the ends of the outsole 200. As can be seen from FIG. 9(*b*), the shaft member 202 comprises a lipped protrusion portion 212 which is equivalent in function to the lipped protrusion edge 144 of FIGS. 5 and 6. However, in this case, the lipped protrusion portion 212 is integrally joined to the shaft member 202.

The shaft member 202, the protrusions 208 and the lipped protrusion edge 212 are made from a harder, tougher or stiffer material than the ground engaging surface of the outsole 200. This outsole structure serves to extend the useful life of the protrusions 208 and the lipped protrusion edge 212, which are subjected to stress and wear. In turn, this permits a more secure fastening of the attachment 100 onto the protrusion 208.

The protrusions are integrally formed with the shaft member 202 such as by molding. The shaft member 202 can be joined to the outsole 200 by molding the outsole 200 over the shaft member 202. Alternatively, the shaft member 202 and the outsole 200 may be joined using adhesive or heat. Instead of the shaft member 202 extending along the entire length of the outsole 200, it could terminate at an arch region 210 of the outsole 200. In this case, two shaft members 202 can be provided. This outsole structure may also be applied to the embodiment illustrated in FIGS. 1 to 4. In this case, however, the shaft member would extend from side-edge to side-edge of the outsole.

A further alternative embodiment of the invention is illustrated in FIGS. 10 to 13 comprising attachments 300 having a body 302, an attaching portion 304 associated with the body and a detaching portion 306 associated with the body. The attachments 300 include a heel attachment 308 and a front attachment 310 which include one differing feature which will be described later.

As with the previous embodiment, the body 302 has a body opening 312 and defined by an opening edge 314. The body 302 is symmetrical about a longitudinal axis which allows the attachment 300 to be reversible. The body 302 is made from a resiliently deformable material. The body 302 has first and second body surfaces 302*a*, 302*b*. Protrusions 303 extend from the first body surface 302*a*. In this embodiment, the protrusions are made of metal and are particularly suited to improving traction on icy surfaces.

The attaching portion 304 includes a first attaching portion 316 and a second attaching portion 318. The first attaching portion includes a portion 320 of the body opening edge 314 which is shaped to inter-engage with a portion of an outsole 324. The second attaching portion 318 is located at an oppositely facing side of the body 302 to the first attaching portion 316 and includes another portion 326 of the body opening edge 314 which is shaped to inter-engage with a portion of the outsole 324. It has the same structure as the first attaching portion 316. The edge portions 320, 326 taper towards each other. The structure and function of the first and second attaching portions 316, 318 are the same as that of the second attaching portion of FIGS. 5 to 8 and so need not be described further here.

The detaching portion 306 extends from the body, at the same side as the second attaching portion 318, and includes a tab member 328 having a free edge portion which can be manipulated by a user's hand to move the detaching portion 306 with respect to the body 302. The tab member 328 has a recessed portion for improving its gripability.

The front attachment 310 is larger than the heel attachment to suit its intended location on the outsole. Therefore, to provide stability to the body 302 and to maintain its shape, the body 302 includes a bridging member 331 extending across the body opening 312. The bridging member 331 is provided with an opening 331 a to promote the stretchability of the bridging member 331 for ease of attachment and detachment from the outsole 324.

Figure 10:
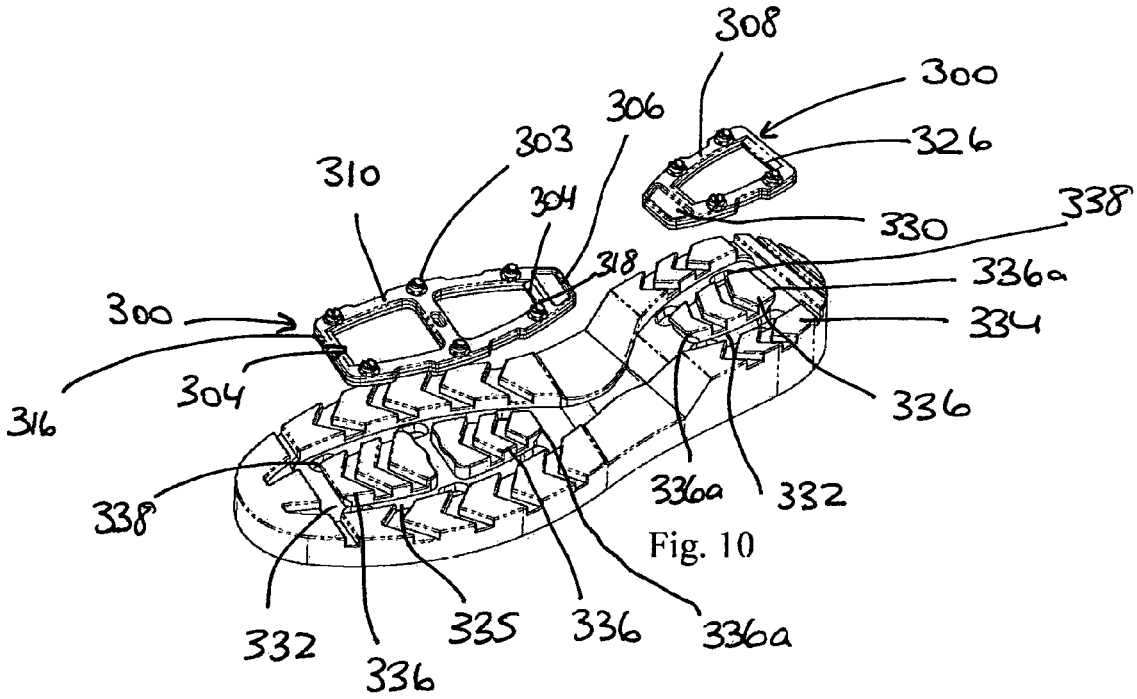
FIG. 10 is an exploded perspective view of a heel attachment, a front attachment and an outsole according to yet another embodiment of the invention.
Figure 11A:
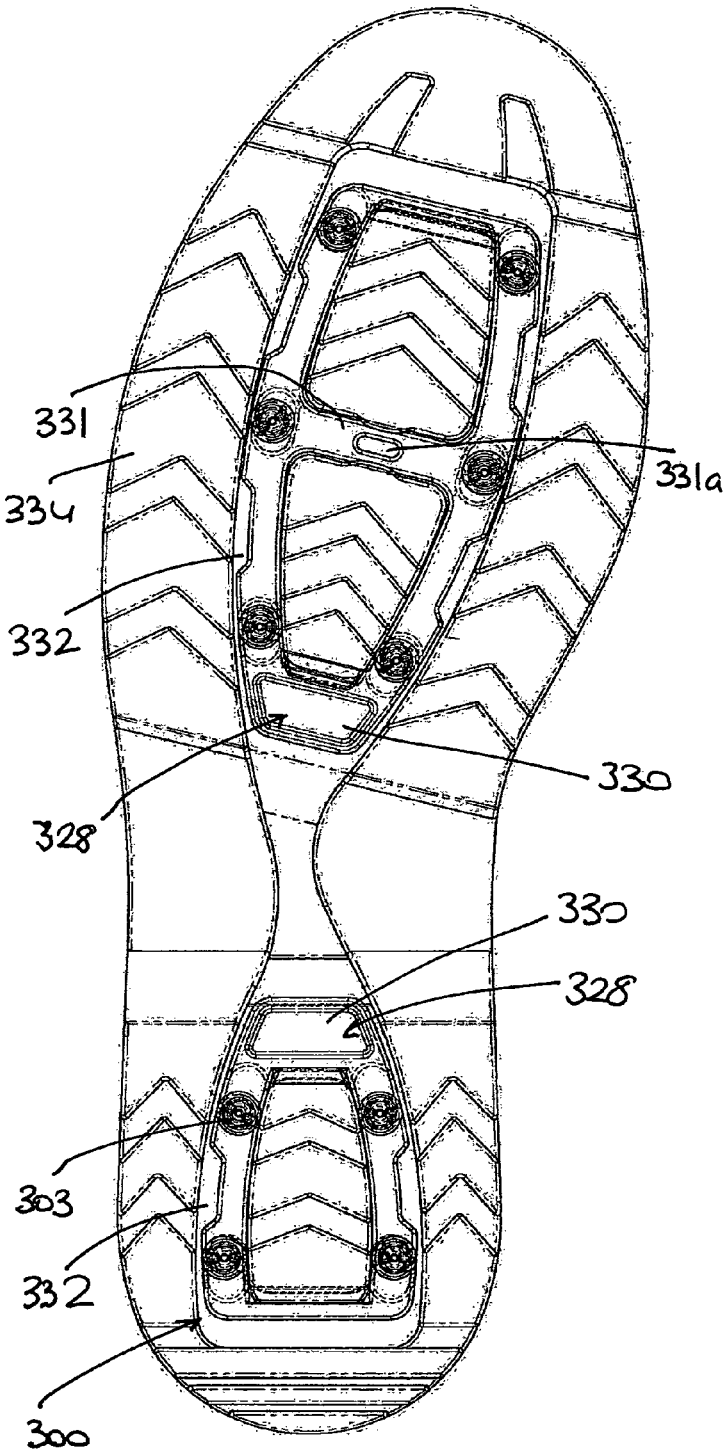
FIG. 11(*a*) is a plan view of the attachments and the outsole of FIG. 10 when the attachments are attached to the outsole.
Figure 11B:
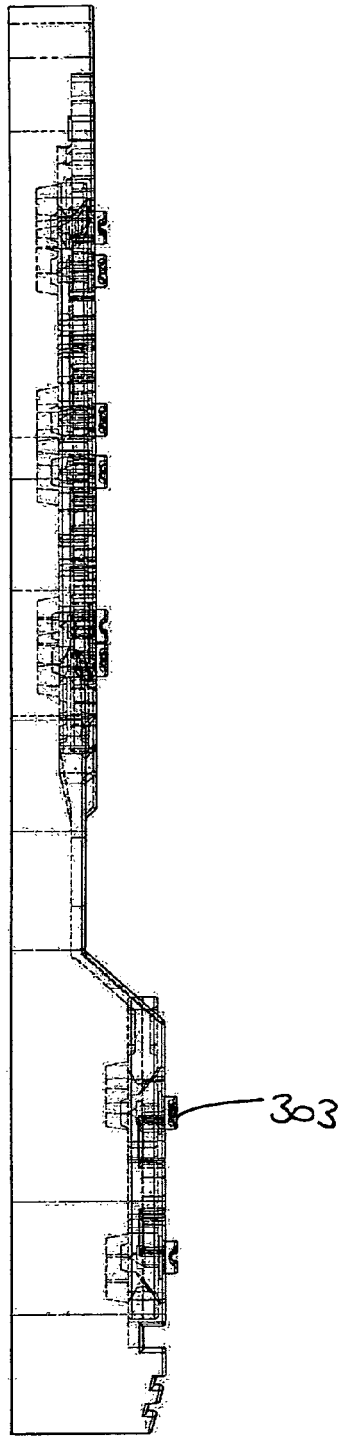
Figure 12A:
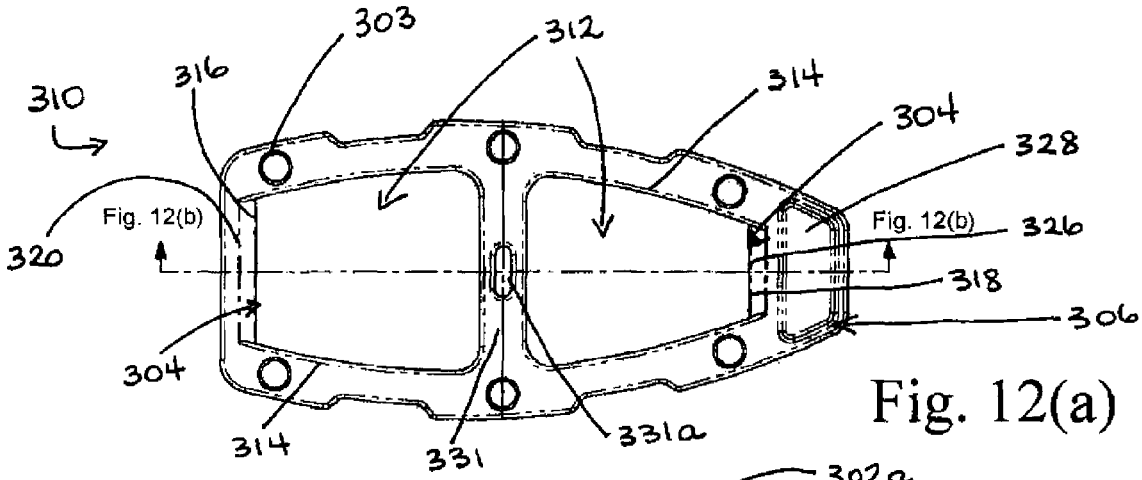
FIG. 12(*a*) is a plan view of the front attachment of FIG. 10.
Figure 12B:
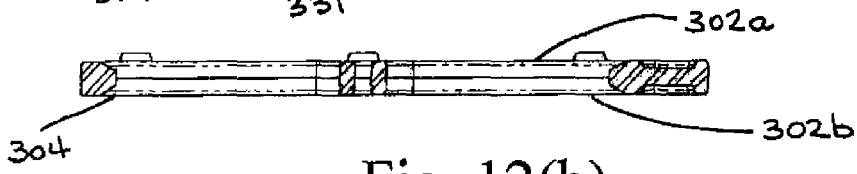
Figure 13A:
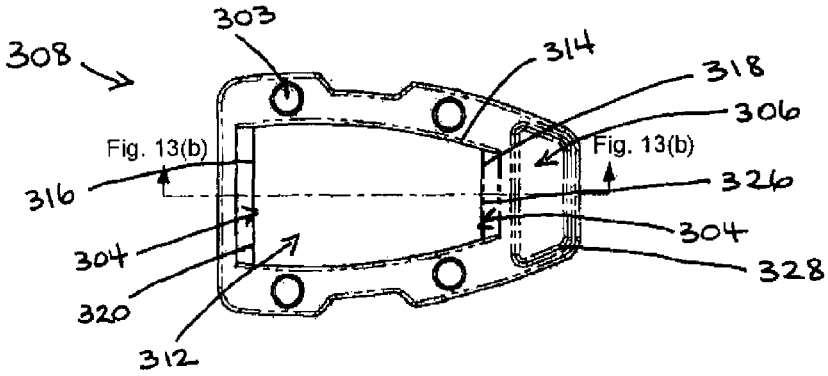
FIG. 13(*a*) is a plan view of the heel attachment of FIG. 10.
Figure 13B:
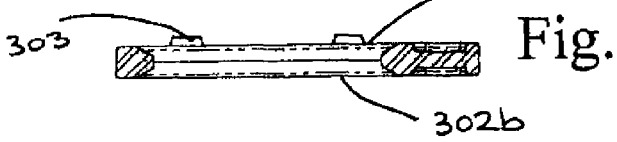

As with the outsole of FIGS. 5 and 6, a recess 332, corresponding to each attachment 300, is formed within a ground-engaging surface 334 of the outsole 324 and has a recess bottom face (base) 335. At least one protrusion 336 extends from the recess base 335 and has oppositely facing lipped protrusion edges 336 for engaging with the body opening edges 314 of the first and second attaching portions 304, 306 of the body. The two lipped portions of the protrusion 336 face away from each other to better retain the attachment 300 on the outsole 324. Openings 338 are provided in the recess base 335 for receiving the protrusions 303 extending from the first body surface 302a when that face 342 is nested in the recess 332. As can be seen in FIGS. 10 and 11, the recess 332 extends beyond the end of the tab member 328 to improve access to the tab member 328 for a user's hands.

The recess 332 for receiving the front attachment 310 includes two side-by-side protrusions 336. The protrusions 336 are spaced apart to accommodate the bridging member 331 of the front attachment 310. Oppositely facing portions 344 of the protrusions are lipped to retain it in position when the attachment 310 is mounted to the outsole 324.

The attachments 300 are mounted to the outsole 324 by engaging the body opening edge 320 of the first attaching portion 316 with its corresponding lipped protrusion edge 336. A user then pulls the attachment 300, for example by gripping the tab member 328 to stretch the body opening edge 326 of the second attaching portion 318 with its corresponding lipped protrusion edge 336. Releasing the tab member 328 yields a securely mounted attachment 300 to the outsole 324. In the case of the front attachment 310, after the tab member 328 has been released, force is applied to an exposed surface of the bridging member 331 to push it past the lipped portions 344 of the recess protrusion 336 and snap it into position.

To detach the attachment 300 from the outsole 324, a user grips the tab member 328 and moves it with respect to the body. By pulling the tab member 328 away from the body 302, the second attaching portion 318 can be disengaged from its corresponding protrusion edge 336. Moving the tab member 328 towards the body 302 and away from the ground-engaging surface 334 of the outsole 324 disengages the-first attaching portion 316 from its corresponding protrusion edge 336. The motion is akin to peeling the attachment 300 from the recess 332.

Figure 15A:
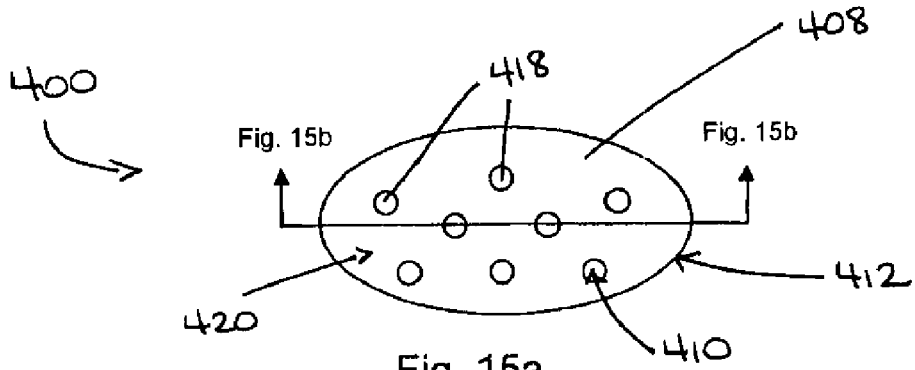
FIG. 15(*a*) is a plan view of an attachment of FIG. 14.
Figure 15B:
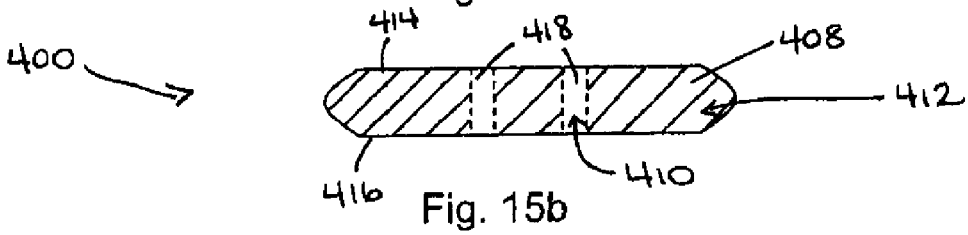
Figure 16A:
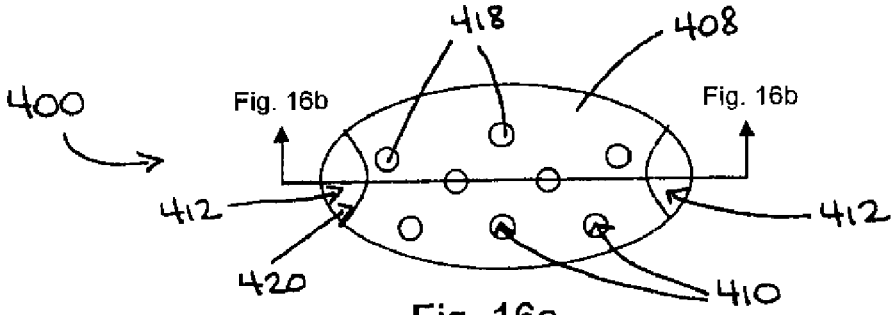
FIG. 16(*a*) is a plan view of an alternative attachment to that of FIG. 15.
Figure 16B:
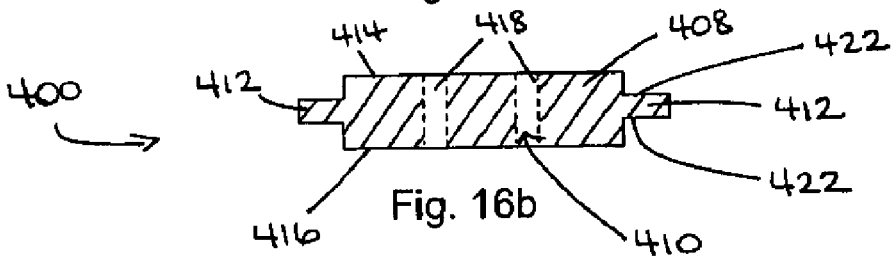

A yet further embodiment of the present invention is shown in FIGS. 14 to 16. There is provided an attachment 400 for mounting to an outsole 402. The attachment can be mounted to a heel portion 404 or a front portion 406 of the outsole 402 and differs only in size and shape according to its intended location. Each attachment 400 includes a body 408, and attaching and detaching portions 410, 412 which are associated with the body 408. The body 408 has first and second body surfaces 414, 416 and is releasably co-operable with the outsole 402 in a first position in which the first body surface 414 is disposable away from the outsole 402 and in a second position in which the second body 416 surface is disposable away from the outsole 402. The body 408 is symmetrical about two axes which allows the attachment 400 to be mounted to the outsole 402 with either body surface 414, 416 exposed and in a left to right and in a right to left configuration.

The first and second body surfaces have different ground engaging properties such as different material densities yielding different coefficients of friction. The body surfaces 414, 416 may be colored differently to help the user distinguish between the two surfaces. Both the first and second body surfaces 414, 416 are substantially planar in that they do not have any protrusions extending from them. These surfaces can be considered to be substantially flat. Therefore, the attachments 400 are particularly well suited to sports shoes such as running or basketball shoes. One of the first and second body surfaces 414, 416 may have traction properties suited to indoor sports (e.g. it can be 'tacky') and the other body surface may be better suited to outdoor conditions (e.g. less 'tacky'). In this way, a sports player can switch the attachment between the first and second positions according to the traction required. The body 20 is illustrated as ellipsoid in shape but can be any other shape. The body is made from a resiliently deformable material.

The attaching portion 410 comprises a plurality of openings 418 formed through the body for engagement with corresponding protrusions of the outsole 402. It will be appreciated that the number, size, shape and arrangement of the openings can vary from the cylindrical openings illustrated in FIG. 15 without departing from the scope of the invention.

The detaching portion 412 includes an outer edge portion 420 of the body 408. The outer edge portion 420 is arranged to be manipulatable by a user using only his or her hands to move the detaching portion 412 with respect to the body 408 when the attachment 400 is mounted to the outsole 402 in the first or second positions. Alternatively, as illustrated in FIG. 16, the detaching portion may be recessed 422, on both sides of the attachment, to improve the manual manipulatability of the attachment 400.

The outsole 402 comprises a recess 424 in a ground-engaging surface 426 for receiving the body 408 of the attachment 400. The recess is sized and shaped to correspond with the size and shape of the body. The recess 424 has a bottom surface (base) 428 from which a plurality of protrusions extend which correspond in size, shape and location to the body openings 418 of the attachment 400. The protrusions 430 are engageably receivable in the body openings 418 to attach the attachment 400 to the outsole 402. The protrusions 430 may be lipped or mushroom-shaped. The recess 424 may also have lipped edges to assist retention of the attachment 400 in the first or second positions.

Two oppositely facing portions of the ground-engaging surface 426 immediately adjacent the recess 424 are provided with tapered openings 432 to allow a user to access the detaching portion 412 of the attachment 400 when the attachment 400 is mounted in the first or second positions. The portions of the outsole recess 424 can be said to extend beyond the periphery of the body 408 of the attachment 400 when it is attached to the outsole and may taper towards the attachment 400. This provides the attachment 400 with free ends which can be gripped by the user and moved relative to the body 408 to detach the attachment 400 from the recess 424. The tapering may also minimize the amount of debris that can collect in the recess.

The attachment 400 is attached to the outsole by placing the attachment 400 over the recess 424 and lining up the openings 418 in the attachment 400 with the protrusions 430 of the recess 424 and pressing the attachment 400 into the recess 424 such that the openings 418 engageably receive their corresponding protrusions. The attachment 400 is snap-fitted onto the outsole 402.

The attachment is detached from the outsole by a user inserting his or her finger or thumb into one of the tapered openings 432 of the outsole 402 and gripping an edge portion of the attachment (i.e. the detaching portion 412). The user then moves the detaching portion 412 with respect to the rest of the body 408 to lift the attachment 400 away from the recess 424 and disengages the protrusions 430 from the openings 418.

Although the fastening system has been described and illustrated as openings 418 and protrusions 430, they may also comprise other inter-engaging formations such as strips, openings, ridges, pins, etc. or a combination thereof. For example, openings may be provided between studs along the perimeter of the attachment 400, and pins projecting from the recess may penetrate and be received into said openings to hold the attachment in place. A person skilled in the art will appreciate that combinations of such molded fastening members are possible which are contemplated to be technically equivalent and under the scope of the present invention.

Figure 17A:
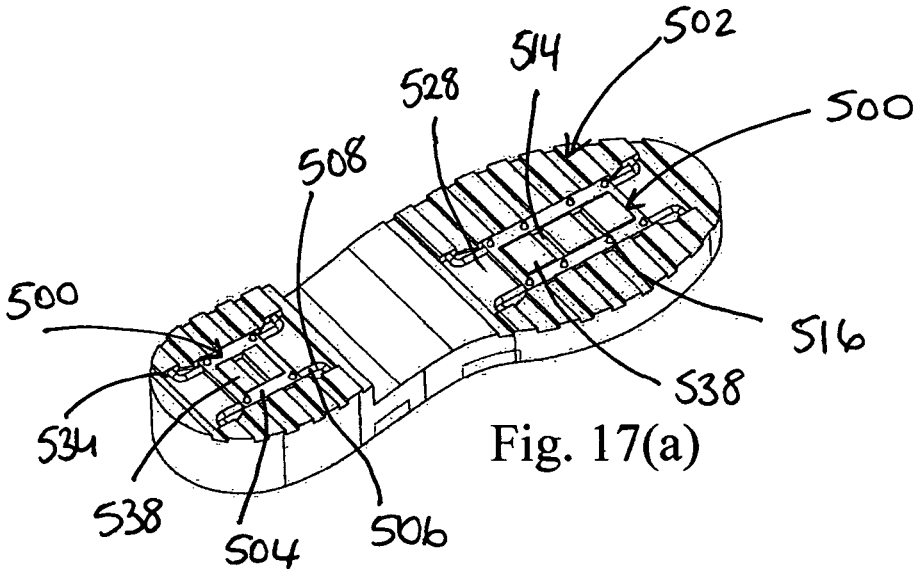
FIGS. 17(*a*) and (*b*) are perspective views of a rear attachment, a front attachment and an outsole according to another embodiment of the present invention, when the attachments are attached to the outsole and when they have been released from the outsole, respectively.
Figure 17B:
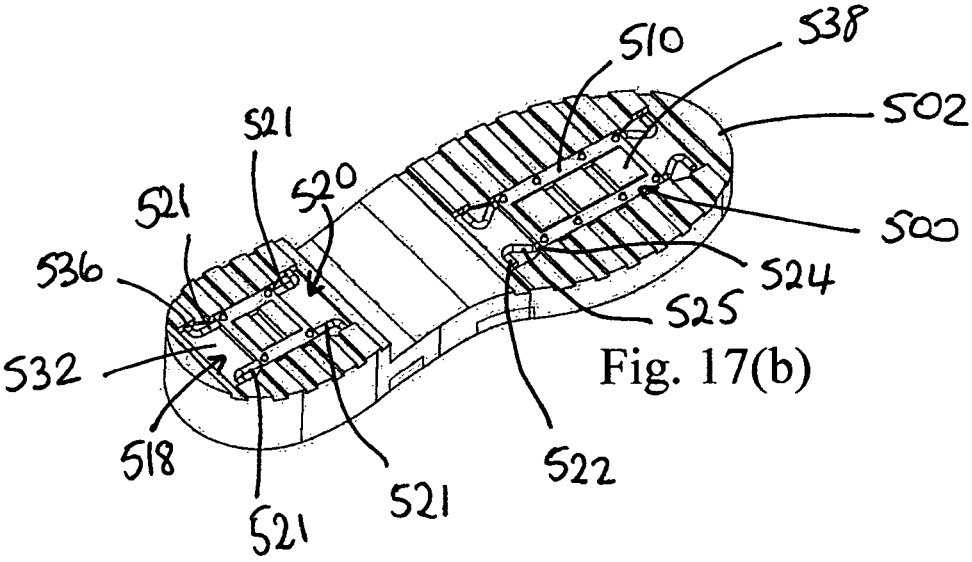
Figure 18A:
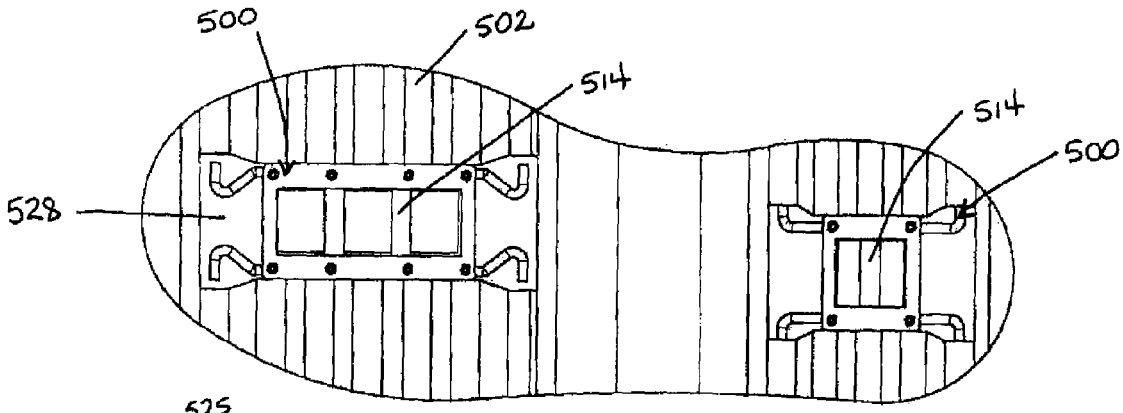
FIGS. 18(*a*) and (*b*) are plan views of FIGS. 17(*a*) and (*b*) respectively.
Figure 18B:
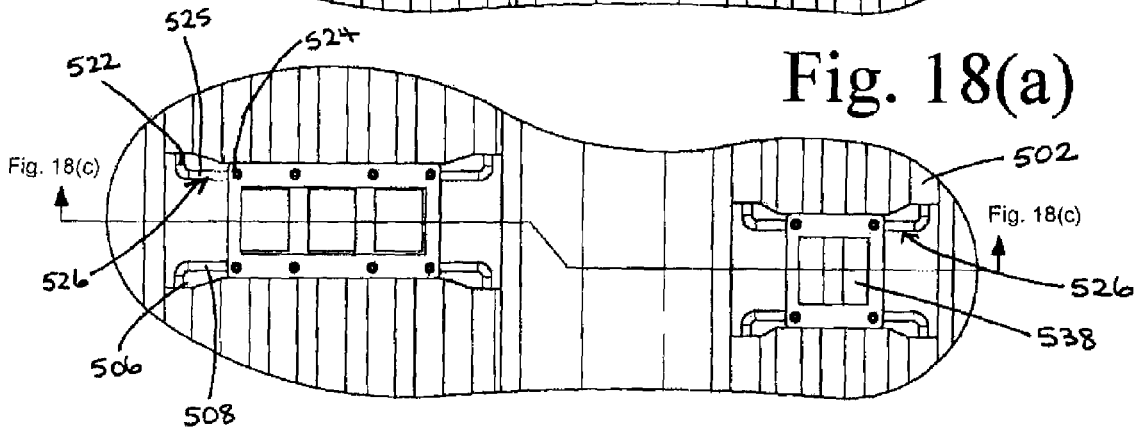
Figure 18C:
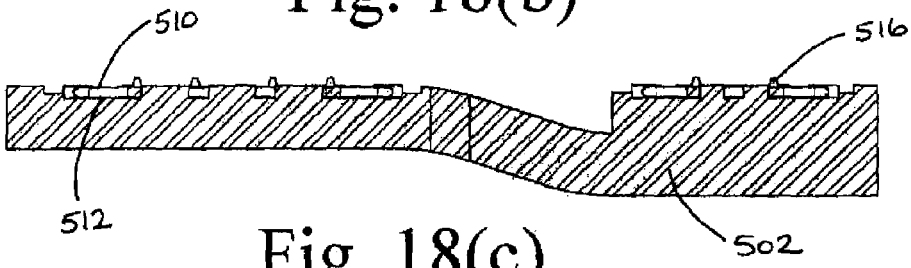

FIGS. 17 and 18 show a yet further embodiment of the invention in which there is provided an attachment 500 and an outsole 502. As with previous embodiments, the attachment 500 comprises a body 504, an attaching portion 506 associated with the body and a detaching portion 508 associated with the body 504. The body 504 has first and second body surfaces 510, 512 and an opening 514 formed therethrough. Protrusions 516 extend from the first body surface 510.

The attaching portion comprises a first pair of arms 518 and a second pair of arms 520 extending from oppositely facing ends of the body 504. Each arm 521 has a free end 522, a connecting end 524 and a main shaft 525. Each arm 521 is moveably joined to the body 504 such that the arm 521 is moveable with respect to the body 504. As can be seen in FIG. 17(*b*), the arm 521 has a modular construction where the free end 522 and the main shaft 525 are moveable with respect to the connecting end 524. The arms 521 could also be rigid along their length and be joined to the body by a hinge, for example, about which they move.

The attaching portion includes the free end 522 of the arm 521 which is receivably engageable in openings in the outsole 502. The arms 521 in each pair are substantially parallel to each other when the free ends 522 are engageably received in the outsole 502. The free end of the arm may be made from a more rigid material than the rest of the arm for improved retention in the outsole 502. The detaching portion includes an edge portion 526 of each arm 521 which is moveable with respect to the body 504 by virtue of the arm 521 being moveable with respect to the body 504. A user can move the arms 521 and hence the detaching portion 508 using his or hands when the attachment 500 is in position on the outsole 502.

The outsole 502 of this embodiment comprises a recess 528 in a ground engaging surface at each of the heel and forefoot portions of the outsole 502 for receiving the attachments 500. Each recess has a bottom surface (base) 532 and side walls 534. Openings 536 are provided in the side walls 534 for engageably receiving the free ends 522 of the arms 521. The position of the openings 536 correspond to the location of the free ends 522 of the arms 521 such that, when the body 504 is nested in the recess 528, moving the arms 521 of each pair 518, 520 away from each other, towards the recess side wall 534, inserts their free ends 522 into the openings 536 to fasten the attachment 500 to the outsole 502 (extended position). Moving the arms 521 of each pair towards each other, away from the recess side wall 534 disengages their free ends 522 from the openings 536 to release the attachment 500 from the outsole 502 (retracted position). Specifically, the recess side wall 534 includes, at one end of the recess 528, a pair of oppositely facing openings 536 corresponding to the first pair of arms 518. At another end of the recess, the recess side wall 534 includes another pair of oppositely facing openings 536 corresponding to the second pair of arms 520. The outsole recess 528 extends beyond the attachment 500 when the attachment 500 is attached to the outsole 502. This provides enough space around the arms 521 of the attachment 500 to allow a user to manually manipulate the arms 521 and the detaching portion 508.

At least one protrusion 538 extends from the bottom surface (base) 532 of the recess 528 to be receivably engaged in the body opening 514. The protrusion 538 serves the dual purpose of locating the attachment 500 in the correct position in the recess and enhancing the attachment security of the attachment 500 to the outsole. An edge of the protrusion may be lipped to enhance the attachment even further such that the attachment 500 can be snap-fitted over the protrusion 538. As for the previous embodiments, openings (not shown) may be provided in the recess bottom surface (base) 532 for receiving the protrusions 516 extending from the first body surface 510 when the attachment 500 is positioned with its second body surface 512 facing outwardly.

The attachment 500 is mounted on the attachment by aligning the body opening with the protrusion and nesting the attachment 500 in the recess 528, when the arms 521 are in the retracted position (as illustrated in FIG. 17(*b*)). The arms are then moved to the extended position (as illustrated in FIG. 17(*a*)) by the user pushing each arm 521 of a pair of arms 518, 520 away from each and towards the opening with which it engages.

The attachment is removed from the outsole by moving the arms 521 of a pair of arms 518, 520 towards each other and away from its mating opening. The moveable connection of the arm 521 to the body 504 may be by means of a spring and/or latch connection (not shown) such that the arm 521 is resiliently biased to the retracted position and moving it to the extended position locks it in this position. In this case, moving the arm 521 away from the other arm of its pair, and towards its mating opening, will release the latch to spring the arm 521 back into the retracted position. Each of the arms 521 are sequentially released from their corresponding openings in this way to release the attachment 500 from the outsole 502. In an alternative embodiment (not shown) the arms 521 may be arranged to clamp the attachment into position in the recess, instead of engaging with holes in the recess.

This embodiment of the invention is particularly useful for outsoles assembled by welt stitching since the recesses 528 and the attachments 500 are enclosed within the outer perimeter of the outsole 502. Also, excessive wear is avoided that may result with embodiments in which components extend up to or beyond the outsole perimeter, especially at the toe-end of the outsole.

Figure 19A:
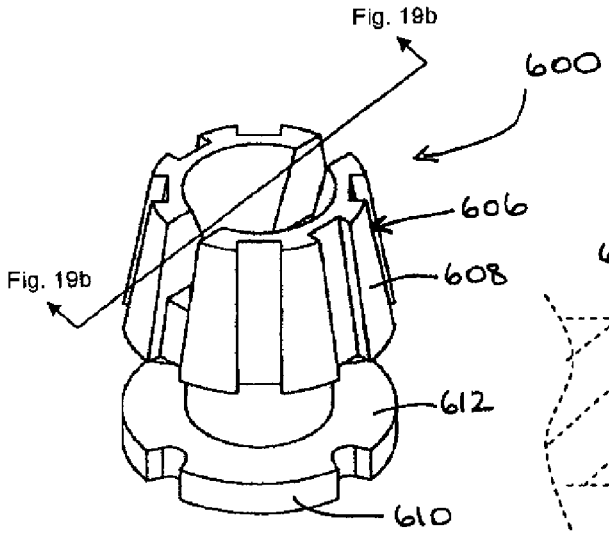
FIG. 19(*a*) is a perspective view of a protrusion of an attachment according to the present invention.
Figure 19B:
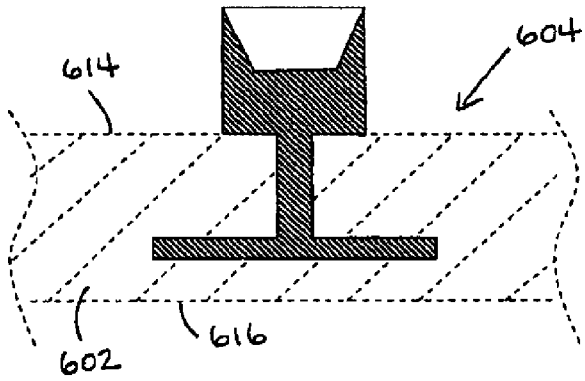

Referring now to FIGS. 1 to 13, and 17 to 18, and particularly to FIGS. 19 and 20, the various designs of the protrusions will now be described. For example, the protrusions extending from a body surface of the attachment may vary from the form illustrated. FIG. 19 shows a cleat 600 of the present invention, attachable to a body 602 of an attachment 604. The cleat 600 has a head 606 having a ribbed outer surface 608 which can also be of any other shape suitable for increasing the traction in ice, snow or mud The head 606 is connected to an anchoring plate 610 via a neck 612. The cleat 600 is intended to be pre-formed and joined to the body 602 of the attachment 604 during the forming of the body 602. As can be seen from FIG. 19(*b*), the cleat 600 is attached to the body 602 such that the cleat head 606 projects beyond a body surface 614 of the body 602. The neck 612 and the anchoring plate 610 are embedded in the attachment body 602. The anchoring plate anchors and stabilizes the cleat 600 within the attachment body 602, and reduces the chance of the cleat 600 being pulled out of the body 602. The cleat 600 may also be provided with a collar (not shown) adjacent its head 606 which will lie on the body surface 614 of the attachment 604 when the cleat 600 is joined to the attachment 604. This collar further stabilizes the cleat and reduces the chance of the cleat becoming further embedded in the attachment body 602. In an alternative embodiment, the neck 612 may extend through the thickness of the attachment body 602 and protrude from the other body surface 616. It will be appreciated that if the attachment 604 is made from a multi-layer construction, the anchoring plate 610 may be embedded into a stiffer layer and coated with a more resilient material.

Figure 20A:
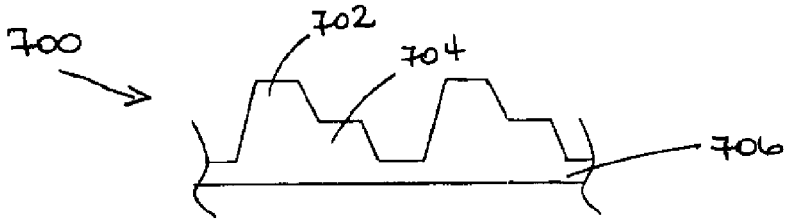
FIGS. 20(*a*) to (*c*) are side views of alternative protrusions to FIG. 19.
Figure 20B:
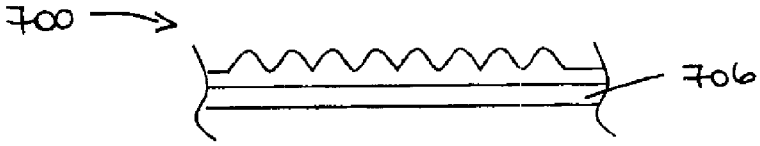
Figure 20C:
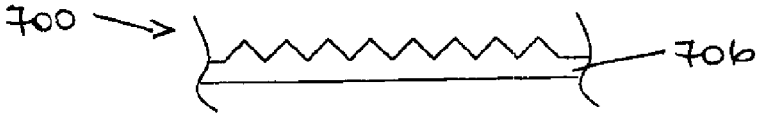

Other shapes of protrusions are contemplated such as those shown in FIG. 20. In FIG. 20(*a*) a protrusion 700 is provided with two teeth 702, 704, one 702 extending further than the other 704 from a body 706 of an attachment. The applicant has found this protrusion to be particularly effective in improving the traction in muddy grass surfaces. FIGS. 20(*b*) and (*c*) illustrate further alternative shapes of protrusions which may be molded integral with the attachment body of an attachment. In addition, since attachments according to the present invention are completely removable, it is contemplated that different types of similarly shaped attachments with different pairs of ground engaging properties may be substituted in a given footwear outsole, to select from other properties.

The invention encompasses a body having first and second body surfaces. These body surfaces can differ from those illustrated herein, such as for example, the surfaces may also include taps (for tap dancing footwear) having different sounds on engagement with a surface, or surfaces with different degrees of friction as may be desirable for bowling shoes, or other sports shoes. Surfaces with varied texture, such as a sponge-like material, are also envisaged for wet weather condition sports shoes, for example.

Furthermore, although the present invention has been described and illustrated by reference to two attachments, one mountable to a heel portion of an outsole and the other one to a fore (front) portion of the outsole, the attachments can be provided as a single attachment mounted to either portion of the outsole, or extending from the heel to the metatarsus or toe portions, as directed by the needs of the contemplated application.

Although the attachment has been described as being releasably attachable to outsoles of footwear, it can also be attachable to knee and elbow pads or anything else which would require a surface change. The outsole need not be provided with a recess for receiving the attachment. The attachment could be fixed over the ground-engaging surface of the outsole such that the exposed surface of the attachment forms the ground engaging surface.

It should be appreciated that the invention is not limited to the particular embodiments described and illustrated but includes all modifications and variations falling within the scope of the invention as defined in the appended claims.

The invention claimed is:

1. An outsole for an item of footwear, the outsole including at least one protrusion extending from the outsole suitable for engagement with a corresponding at least one opening in an attachment, the outsole being releasably attachable to the attachment, the attachment comprising:

a body having first and second body surfaces, the body being releasably co-operable with the outsole in a first position in which the first body surface is disposable away from the outsole and in a second position in which the second body surface is disposable away from the outsole;

an attaching portion which is associated with the body and which includes the at least one opening for releasably attaching the attachment in the first and second positions; and a detaching portion which is associated with the body, the detaching portion having an edge portion moveable with respect to the body to allow the attachment to be released from outsole.

2. An outsole as claimed in claim 1, the outsole being shaped to allow the detaching portion of the attachment to be manipulatable by a user's hand to detach the attachment from the item of footwear.

3. An outsole as claimed in claim 1, wherein the at least one protrusion is at a toe-end, a heel-end, an arch region and/or at a side of the outsole.

4. An outsole as claimed in claim 1, wherein the at least one protrusion is resiliently deformable.

5. An outsole as claimed in claim 1, wherein the at least one protrusion is integral with a shaft member which is associated with the outsole and is more rigid than the outsole.

6. An outsole as claimed in claim 1, including a recess shaped to receive at least a portion of the attachment.

7. An outsole as claimed in claim 6, wherein at least a portion of an edge of the recess is shaped to allow a user to manipulate by hand the attachment when the attachment is in the first or second positions to detach the attachment from the item of footwear.

8. An outsole as claimed in claim 6, wherein at least a portion of an edge of the recess is lipped to allow retention of the attachment in the recess.

9. An outsole as claimed in claim 6, wherein the recess has a base from which extends a protrusion, the protrusion being shaped to engage with a corresponding opening in the attachment to releasably attach the attachment to the outsole.

10. An outsole as claimed in claim 6, wherein the recess has a base, the base having at least one opening therein which is shaped to receive at least one corresponding protrusion of the attachment.

11. An outsole as claimed in claim 6, wherein the recess has a side wall, the side wall having at least one opening for engagement with a corresponding protrusion of the attachment.

12. An item of footwear including an outsole according to claim 1.

13. An outsole as claimed in claim 1, wherein the at least one protrusion is hook-shaped.

14. An outsole as claimed in claim 1, wherein the at least one protrusion is a tread of the outsole.

15. An outsole as claimed in claim 1, wherein the outsole has a recess to receive at least a portion of the attachment and the at least one protrusion extends from a base of the recess.

16. An outsole as claimed in claim 1, further comprising the attachment.

17. An outsole for an item of footwear, the outsole including first and second protrusions which are releasably attachable to an attachment, the first protrusion extending from a heel or a toe area of the outsole for engagement with a first opening in the attachment, the second protrusion extending from an arch area of the outsole for engagement with a second opening in the attachment, the attachment comprising:

a body having first and second body surfaces, the body being releasably co-operable with the outsole in a first position in which the first body surface is disposable away from the outsole and in a second position in which the second body surface is disposable away from the outsole;

an attaching portion which is associated with the body and which includes the first and second openings for releasably attaching the attachment in the first and second positions; and a detaching portion which is associated with the body, the detaching portion having an edge portion moveable with respect to the body to allow the attachment to be released from the outsole.

18. An outsole as claimed in claim 17, wherein the first and second protrusions are hook-shaped.

19. An outsole as claimed in claim 17, wherein the outsole has a recess to receive at least a portion of the attachment and at least one of the first and second protrusions extend from a base of the recess.

20. An outsole as claimed in claim 17, wherein the second protrusion is integral with a shaft member which extends along at least a portion of the outsole and is joined to the outsole.

21. An outsole as claimed in claim 17, further comprising the attachment.

* * * * *